US008955416B1

(12) United States Patent
Ragner

(10) Patent No.: US 8,955,416 B1
(45) Date of Patent: Feb. 17, 2015

(54) PIVOTAL DOUBLE NESTED WRENCH ENDS

(71) Applicant: Gary Dean Ragner, Gainesville, FL (US)

(72) Inventor: Gary Dean Ragner, Gainesville, FL (US)

( * ) Notice: Subject to any disclaimer, the term of this patent is extended or adjusted under 35 U.S.C. 154(b) by 0 days.

(21) Appl. No.: 14/229,973

(22) Filed: Mar. 30, 2014

Related U.S. Application Data

(60) Provisional application No. 61/806,877, filed on Mar. 30, 2013.

(51) Int. Cl.

| | |
|---|---|
| ***B25B 13/00*** | (2006.01) |
| ***B25F 1/04*** | (2006.01) |
| ***B25B 23/00*** | (2006.01) |
| ***B25B 23/16*** | (2006.01) |

(52) U.S. Cl.
CPC ..... *B25F 1/04* (2013.01); *B25B 23/0035* (2013.01); *B25B 23/16* (2013.01)
USPC ..... 81/124.4; 81/60; 81/57.5

(58) Field of Classification Search
USPC ..... 81/121.1, 124.4, 124.5, 119, 440, 57.5, 81/125.1, 177.6–177.9, DIG. 6, 60; 7/165, 7/168; D8/17, 21
See application file for complete search history.

(56) References Cited

U.S. PATENT DOCUMENTS

| | | | | |
|---|---|---|---|---|
| 1,571,148 | A | 1/1926 | Sisolak | |
| 1,613,976 | A | 1/1927 | Bellows | |
| 1,796,083 | A | 3/1931 | Carlberg | |
| 1,930,238 | A | 10/1933 | Heller | |
| 2,097,361 | A * | 10/1937 | Bagley | 81/177.6 |
| 4,840,094 | A | 6/1989 | Macor | |
| 5,325,744 | A | 7/1994 | Horikawa | |
| 5,557,992 | A | 9/1996 | Macor | |
| 6,109,142 | A | 8/2000 | Learng | |
| 6,112,625 | A | 9/2000 | Turtle | |
| 7,047,844 | B1 | 5/2006 | Macor | |
| 7,966,912 | B1 | 6/2011 | Hobden et al. | |
| 8,069,753 | B2 | 12/2011 | Kriz et al. | |
| D658,459 | S | 5/2012 | Meholovitch | |
| 8,230,766 | B2 | 7/2012 | Chang | |
| 8,302,510 | B2 | 11/2012 | Macor | |
| 2011/0120275 | A1 * | 5/2011 | Macor | 81/124.5 |
| 2011/0232424 | A1 * | 9/2011 | Chang | 81/60 |
| 2012/0060653 | A1 | 3/2012 | Hsu | |
| 2012/0260775 | A1 * | 10/2012 | Lance et al. | 81/57.5 |

* cited by examiner

*Primary Examiner* — Lee D Wilson
*Assistant Examiner* — Melanie Alexander

(57) ABSTRACT

A hand tool for holding a plurality of wrench head tools on the end of a handle, comprising a handle with a handle hinge paw and at least two pivotal wrench head tools pivotally mounted to the handle hinge paw, at least one pivotal wrench head tool defining a second hinge paw and at least one pivotal wrench head tool defining a pivotal arm post. Wherein the pivotal arm post is pivotally mounted within the second hinge paw which is pivotally mounted within the handle hinge paw. The wrench handle may also comprise a folding hinge to allow both a smaller stowed position and a larger unfold or extended operational position for the hand tool. The handle may also comprise a central hub and/or further include additional non-wrench tools. The hand tool may also comprise a hinge locking mechanism for each folding and/or pivotal hinge.

5 Claims, 5 Drawing Sheets

Fig. 1A - Prior Art

PIVOTAL DOUBLE NESTED WRENCH ENDS

CROSS-REFERENCE TO RELATED APPLICATIONS

Figure 1C:
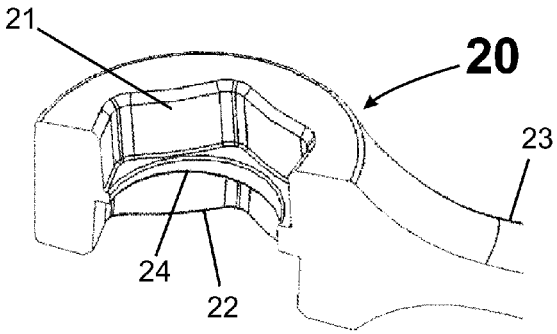
Fig. 1C Prior Art
Figure 1C:
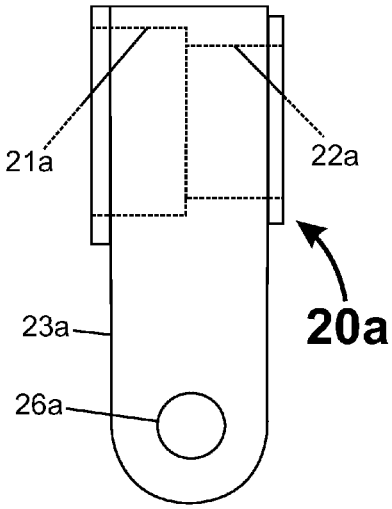
Fig. 1C Prior Art

This non-provisional application claims priority and benefit from U.S. Provisional Application Ser. No. 61/806,877, filed on Mar. 30, 2013, titled: "PIVOTAL DOUBLE NESTED WRENCH ENDS" by the same inventor, the disclosure of which is hereby incorporated by reference in its entirety.

BACKGROUND

1. Field of Invention

The field of this invention relates to hand tools for the purpose of turning rotary fasteners, and more specifically to wrenches that have two pivoting wrench heads mounted on a single pivotal hinge.

2. Background

The present state of the art for hand tools is very diverse. For wrenches, a typical set of hand wrenches can come in sets of six or more sizes and various styles. These sets usually come in a carrying case or other holding structure to keep the multiple tools together. The disclosed double nested wrench ends allow for four or more wrench sizes to be ergonomically positioned on one end of a handle or tool arm using a single pivotal hinge or pivot pin. This single pivotal hinge can comprise a pressure fitted pivot pin, a riveted pivot pin, threaded pivot pin, or other pivotal hinge mounting means. The disclosed double nested wrench designs can also be configured with a folding hinge to allow a short, low-profile position for stowage. This stowed position can be accomplished by including a folding hinge near the center of the hand tool so that each end of the hand tool can fold substantially together on one side of the folding hinge. In this way, a very compact stowed position can be achieved for folding hand tools with double nested wrench ends and additional tools (e.g., a screwdriver).

Wrench and socket heads have been used for nearly a century to turn a rotary fastener of various sizes and shapes. Sockets typically have a significant vertical height when engaging a rotary fastener. Sockets also tend to be designed to be removable from the tool handle or tool arm so that only one wrench handle or ratchet wrench is need for the entire set of sockets. Wrench heads on the other hand, generally have a much lower profile (smaller vertical height above a rotary fastener during use) than a socket, and/or are normally permanently attached to its tool arm (handle). The exact difference in structure between a "socket" and a "wrench head" is blurred by the fact that both provide similar functions, but the difference often comes down to the fact that most "sockets" are designed for removable attachment to a wrench handle, or ratchet and also tend to have a much higher vertical profile. For the disclosed double duplex wrench heads presented here, the vertical profile (vertical height) of the wrench head can have a wide variety of lengths depending on the intended use. For most wrench applications, the duplex wrench heads presented here can be permanently attached to its respective wrench head pivot arm. Depending on the intended use, the wrench head gripping surfaces can have a longitudinal length (vertical height) ranging from a fraction of its gripping surface's diameter to as great as three times its exterior diameter. Duplex wrench heads shorter than the diameter of its gripping surface (see duplex wrench head assemblies 71*a* and 72*a* in FIG. 4A) can be used to reach rotary fasteners in vertically tight spaces, while the longer duplex wrench heads (see duplex wrench head assemblies 71*b* and 72*b* in FIG. 4A) can be used to reach rotary fasteners within indented areas. Thus, the vertical height of a wrench head or a wrench socket can be thought of as the height the wrench head or socket extends above a surface when engaging a rotatory fastener on that surface and would include any additional height from the wrench handles, ratchets, and arms that are positioned above the rotary fastener when the wrench or socket is engaged for use.

Figure 4A:
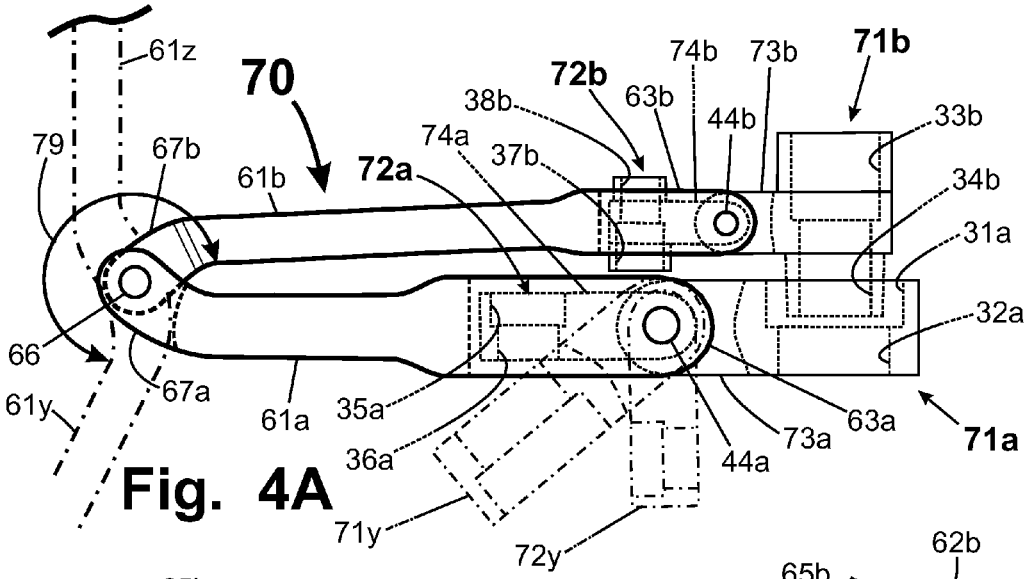

In FIG. 1A, we see duplex wrench head 20 is shown with a longitudinal length slightly less than the diameter of its larger gripping surface 21. In FIGS. 1C-D, we see prior art Craftsman® Figure Eight® wrench comprising a duplex wrench heads 20*a* which has a tool length (vertical height during use) approximate equal to the diameter of its larger gripping surface 21*a*. In FIG. 4A, we see a wrench heads 71*b* and 72*b* with a vertical height that is approximately twice the diameter of its larger gripping surface 33*b* and 37*b*, respectively. In the disclosed invention, the longitudinal length, or vertical height, of the wrench heads can be increased to two, three, or four times its diameter to provide specific wrench needs. As the longitudinal length of the wrench heads increase above twice its gripping surface diameter, the wrench heads can reach down into deeper and deeper indentations to turn a rotary fastener and begin to provide a socket-like function for the hand tool.

The duplex wrench heads presented here can comprise a variety of gripping surfaces for use with different types of fasteners. Some of the rotary fastener gripping surfaces commonly used today comprise: 1) four-point standard (square shape), 2) six-point standard (hexagon shape, see FIG. 3A), 3) twelve-point standard (double hexagon, see FIG. 3B), 4) twelve-point spline (see FIG. 3B), 5) lobed gripping surfaces (both six and twelve point), 6) Torex® gripping surfaces, 7) asymmetric gripping surfaces, 8) variations on these basic gripping surfaces, and 9) many other specialty shape surfaces for various purposes. This list of gripping surfaces is not exhaustive and many other gripping surface designs exist in the patent record that can be used with the disclosed folding wrench system. Besides a large variety of gripping surface types, wrench heads also come in various configurations such as box-end wrench heads, open-end wrench heads, flare nut wrench heads, overlapped wrench heads, duplexed wrench heads, overlapped and duplexed wrench heads, ratcheting open-end wrench heads, Jonard Speed wrench heads, and many other specialty wrench heads.

3. Prior Art

In the prior art, duplex wrench heads have been used in various configurations. A few designs exist in the prior art that provide multiple duplex wrench heads in a single wrench end or pivotal duplexed wrench ends, however none were found that provide a double duplex wrench end that provides two pivotal duplex wrench heads with wrench head arms nested one inside to reduce the overall width and size of the wrench as disclosed by the Applicant.

Pivotal duplexed wrench heads are shown in U.S. Pat. No. 1,613,976 to Bellows, U.S. Pat. No. 5,325,744 to Horikawa, U.S. Pat. No. 6,112,625 to Turtle, and U.S. Pat. No. 8,230,766 to Chang. Two duplex wrench heads combined on one tool end are shown in U.S. Patent Application 2011/0120275 to Macor, U.S. Pat. No. 8,302,510 to Macor, and U.S. Pat. No. 8,230,766 to Chang. Four sided pivotal wrench heads are shown in U.S. Patent Application 2012/0060653 to HSU, U.S. Pat. No. 8,069,753 to Kriz, U.S. Pat. No. 7,966,912 to Hobden, U.S. Pat. No. 1,796,083 to Carlberg, U.S. Pat. No. 1,571,148 to Sisolak, and U.S. Design Pat. No. D658,459 to Meholovitch. Also, U.S. Pat. No. 6,109,142 to Learng shows a sliding duplex socket with four gripping surface sizes, and U.S. Pat. No. 1,930,238 to Heller shows a six sided wrench socket that removably attaches at different positions for use.

SUMMARY

The disclosed hand tools comprise a double nested wrench end where two or more separate wrench head assemblies are pivotally mounted on a single end of a hand tool. Duplex wrench heads, or other types and styles of multiple gripping surface size wrench heads can be used for the wrench head assemblies. Each double nested wrench head comprises a large wrench head assembly and a small wrench head assembly. The large wrench head assembly defines a second hinge paw which can be pivotally mounted within a handle's hinge paw (nested within the handle's hinge paw). The small wrench head assembly defines a pivotal arm that can be pivotally mounted inside the large wrench head assembly's hinge paw (double nested within the large wrench head assembly's hinge paw and the handle's hinge paw). This provides a small wrench head assembly that is pivotal within a large wrench head assembly. This arrangement provides high torque strength to the large duplex wrench head because its hinge paw structural comprises two widely spaced pivot arm. This structure also significantly reduces the overall width of the handle's hinge paw. The actual wrench heads used on these designs can be made in many types, styles, sizes depending on the desired use.

The disclosed double nested wrench ends can combine a full set of wrench sizes into a single hand tool (two ends), that can significantly reduce the overall stowed size of the wrench over prior art wrench set designs. In some of the disclosed designs, the wrench handle can fold in different directions around a center folding hinge (handle hinge) while at the same time providing a stable transfer of torque from one end of the wrench to the other end during use. In many cases, the folding wrench handles plus their tool heads can be folded to approximately half their fully extended length (see FIGS. 3B and 4A). In other configurations the tool arms can have significantly different lengths to allow the wrench heads to store compactly adjacent one another (see FIG. 4B), and/or nest next to one another other along the length of the arms (see position of wrench heads assemblies 51*a-b* in FIG. 4B) instead of on top of the other wrench heads (see wrench heads on assemblies 71*a-b* in FIG. 4A). The disclosed hand tools and wrenches can also comprise a central hub with an additional tool arm(s) securely attached to the central hub (see FIGS. 4B-C and 5). With the proper limits placed on the rotation of the hand tool's handles, the additional tools (e.g. screwdrivers assemblies 80 and 80*a*) can be stabilized for ergonomic use. The central hub can alternatively comprise a pivotal tool arm if desired.

The disclosed double nested wrenches can comprise one or more folding hinges that allow the wrench to fold between an extended position for use to a stowed position for compact storage. The exact number of stowed and extended configurations can depend on the number of separate folding hinge joints used, the range of motion of these folding hinge joints, and arrangement of the hinge joints on the wrench. These folding hinges (see FIGS. 3B, and 4A-D) allow the disclosed wrenches to fold into a compact stowed position (see FIGS. 4A-B, and 5) or extend for use (see FIG. 3B). The hinges used to fold the disclosed wrenches can comprise a hinge with a stabilizing means that provide sufficient friction and/or a locking action in the hinge joint so that the wrench handles can hold a particular configuration during use. The stabilizing means can comprise standard friction and locking devices commonly used with hand tools and wrenches, such as, a friction control systems (see FIGS. 4B and 4D), multiple stable position devices (spring biased ball and grooves), and/or hinge locking devices. The term "folding hinge" is used within this patent to identify a pivoting hinge that is used to fold and extend the wrench's handles (arms) for storage and use, respectively. The term "pivot hinge" will most often be used to refer to the hinges that pivot the wrench head assemblies for use. Because of the similarity between the definitions of the words "pivot", "pivoting", and "pivotal", and the terms "fold" and "folding", the terms "pivot", "pivoting" and "pivotal" will sometimes be used when discussing "folding hinges" and the term "fold" and "folding" at times will be used when discussing pivotal tool heads and their hinges.

All the hinges presented in this patent can comprise a friction means and/or locking mechanisms to help hold the tool handles and/or wrench heads arms at a particular angle with respect to the rest of the hand tool. These friction mechanisms (friction means) and locking mechanisms (locking means) can comprise any standard friction or locking system used with tool hinges to help hold a tool arm or handle in place during use. A few examples of friction creating and hinge locking systems are shown in this patent, and other patent applications by the Applicant. Nearly all prior art hinge stabilizing mechanisms (friction and locking mechanisms) for hand tools can easily be made to work on the disclosed wrenches and hand tools.

OBJECTIVES AND ADVANTAGES

Accordingly, many unique structures and advantages of my invention are:

a) To provide a hand tool with four wrench gripping surface sizes pivotally mounded on a handle end using nested multiple gripping surface wrench heads on a single hinge (pivot hinge).

b) To provide a hand tool with four or more wrench sizes on a handle end using two or more duplex wrench heads nested on a single hinge.

c) To provide a wrench tool with a smaller multiple gripping surface wrench head assembly pivotally nested inside the hinge paw of a larger multiple gripping surface wrench head assembly on a single hinge. Where the smaller multiple gripping surface wrench head is pivotal to more than three hundred sixty degrees around the single hinge and the larger multiple gripping surface wrench head is pivotal over a range of less than three-hundred sixty degrees around the single hinge.

d) To provide a wrench tool with a smaller duplex wrench head assembly pivotally nested inside the hinge paw of a larger duplexed wrench head assembly on a single hinge. Where the smaller duplex wrench head is pivotal to more than three hundred sixty degrees around the single hinge and the larger duplex wrench head is pivotal over a range of less than three-hundred sixty degrees around the single hinge.

e) To provide a hand tool with four or more wrench sizes on a handle end using a smaller wrench head assembly nested inside a larger wrench head assembly on a single hinge. Where the smaller wrench head assembly defines a pivot arm for pivotal attachment to the single hinge, and the larger wrench head assembly defines a pivot arm that is split into two separate arms (hinge paw) for pivotal attachment to the single hinge.

f) The hand tool above where the wrench head assemblies comprise a duplexed wrench head.

g) To provide a hand tool with a smaller pivotal duplex wrench head assembly pivotally nested inside a larger pivotal duplex wrench head assembly, both pivotal on a single pivot pin. Where the smaller duplex wrench head defines a single pivot arm, and the larger duplex wrench head defines a hinge paw (two separated pivot arms). Where the single pivot arm is pivotally mounted between the hinge paw arms (two pivotal arms).

h) To provide a folding hand tool comprising two folding tool arms pivotally connected at one end and comprising a hinge paw on the other ends. Wherein a single arm wrench head assembly is pivotally mounted withing a double armed (hinge paw) wrench head assembly.

i) To provide a folding hand tool comprising two handles pivotally mounted together at a folding hinge so that two wrench head assemblies are pivotally mounted on each end of the folding wrench (two wrench heads on each handle) can be folded substantially adjacent each other on one side of the folding hinge.

j) The folding hand tool above where the wrench head assemblies comprise a duplexed wrench head.

k) To provide a folding hand tool comprising two handles pivotally mounted together at a folding hinge so that two wrench head assemblies are pivotally mounted on each end of the folding wrench (two wrench heads on each handle) can be folded substantially adjacent each other on one side of the folding hinge. Wherein each end of the folding wrench comprises a smaller wrench head assembly and a larger wrench head assembly attached with a single hinge. Where the smaller wrench head assembly defines a pivot arm for pivotal attachment to the single hinge, and the larger duplex wrench head defines two spaced arms (hinge paw) for pivotal attachment to the single hinge.

l) The folding hand tool above where the wrench head assemblies comprise a duplexed wrench head.

m) To provide a folding wrench with a folding handle having two hinge paw ends, wherein a large wrench head with hinge paw pivot arms is pivotally mounted within each hinge paw end of the folding handle, and a small wrench head with a pivot arm is pivotally mounted within the hinge paw pivot arms of each large wrench head.

n) The folding wrench above further including at least one other tool attached to the folding wrench that is not a wrench.

o) To provide a folding wrench with a wrench handle having two hinge paw ends, two large wrench head defining a two hinge paw pivot arms, two small wrench head assemblies defining a small pivot arm, wherein each small wrench head assembly is pivotally mounted within one of the hinge paw pivot arms, which are both mounted within one of the hinge paw ends of the wrench handle.

p) The folding wrench above further including a screwdriver tool defined on the folding wrench.

q) To provide a folding hand tool with two folding tool handles pivotally attached to a central hub at one end and defining a hinge paw end on their other end. Wherein a large wrench head with hinge paw pivot arm is pivotally attached within each hinge paw end and one or more small wrench heads are pivotally attached within the hinge paw pivot arm of each large wrench head.

r) The folding hand tool above further including at least one additional tool arm mounted to the central hub and supporting a tool other than a wrench head, such as, screwdriver, knife, hammer, pry bar, pliers, ratchet head, etc.

s) The folding hand tool above where the wrench head assemblies comprise a duplexed wrench head.

t) To provide a folding hand tool with two folding tool handles pivotally attached to a central hub at one end and defining a hinge paw end on their other end. Wherein a large wrench head with hinge paw pivot arm is pivotally attached within each hinge paw end and one or more small wrench heads are pivotally attached within the hinge paw pivot arm of each large wrench head and further including a screwdriver tool defined on the folding hand tool.

u) The folding hand tool above wherein the screwdriver tool defines an additional tool arm attached to the central hub designed to reversibly attach to a screwdriver assembly, wherein the screwdriver assembly comprises a connecting port on each end for reversibly attaching a double-ended screwdriver bit, whereby as many as four different screwdriver bits can be used with the screwdriver assembly.

v) To provide a folding hand tool comprising a central hub defining a screwdriver tool and two folding handles pivotally attached to the central hub, wherein the two folding handles are pivotal between a stowed position where the two handles are longitudinally adjacent the screwdriver tool and a hand grip position where the two handles are adjacent each other on the opposite side of the central hub from the screwdriver tool, wherein the two handles provide a hand grip for use of the screwdriver tool.

DRAWING FIGURES

FIG. 1A Prior art duplex wrench head with hex gripping surfaces.

Figure 1B:
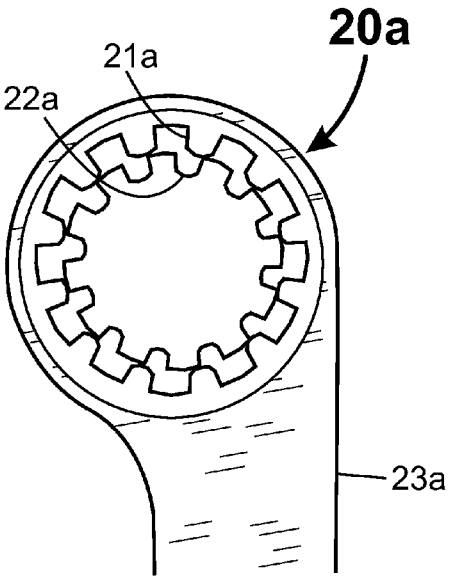
Fig. 1B Prior Art
Figure 1D:
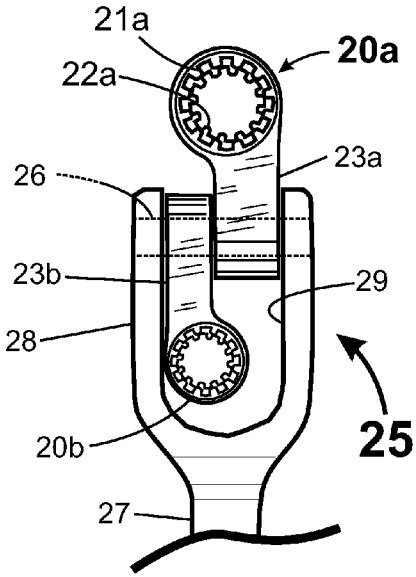
Fig. 1D Prior Art

FIG. 1B Prior art duplex wrench head with spline gripping surfaces (side view).

FIG. 1C Prior art duplex wrench head with spline gripping surfaces (Front view)

FIG. 1D Prior art Figure Eight® wrench head with two single nested wrench heads with spline gripping surfaces (Front view).

Figures 2A, 2B:
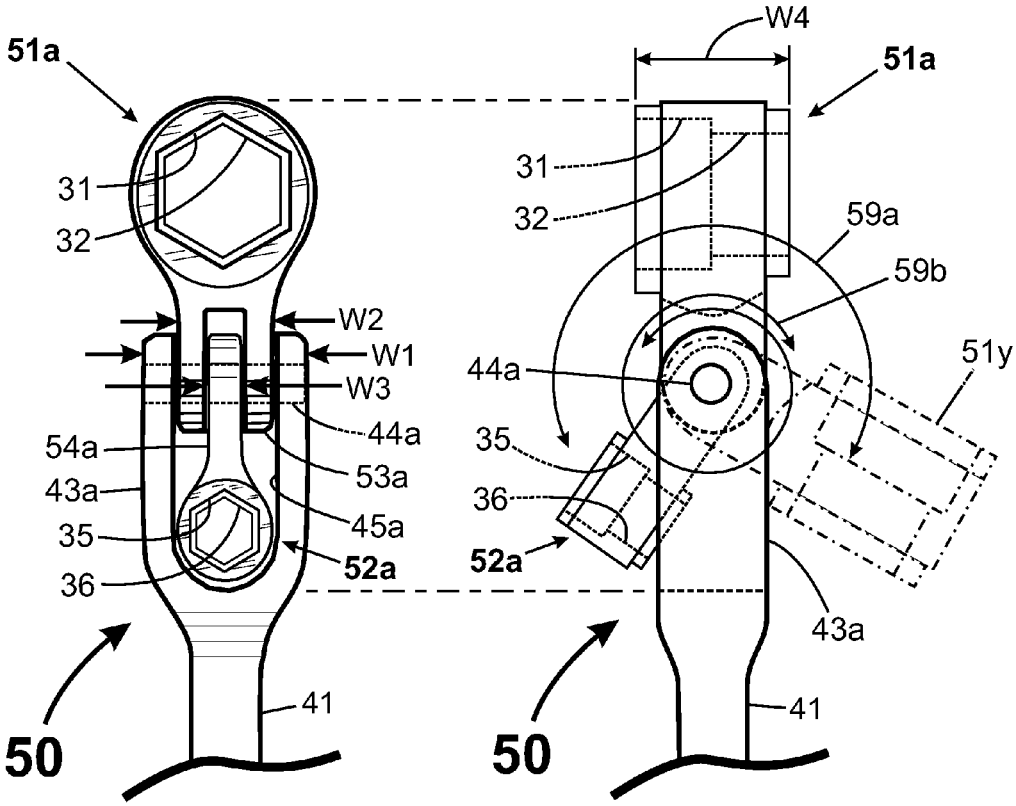

FIG. 2A Front View of a first embodiment of a double nested wrench end with standard six point gripping surfaces.

FIG. 2B Side View of the first embodiment of a double nested wrench end.

Figure 2C:
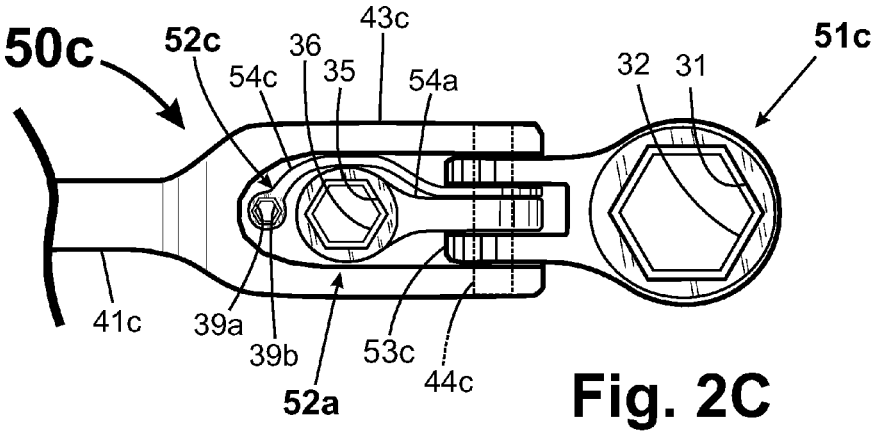

FIG. 2C Front View of a second embodiment of a double nested wrench end having three separate wrench head assemblies.

Figure 3A:
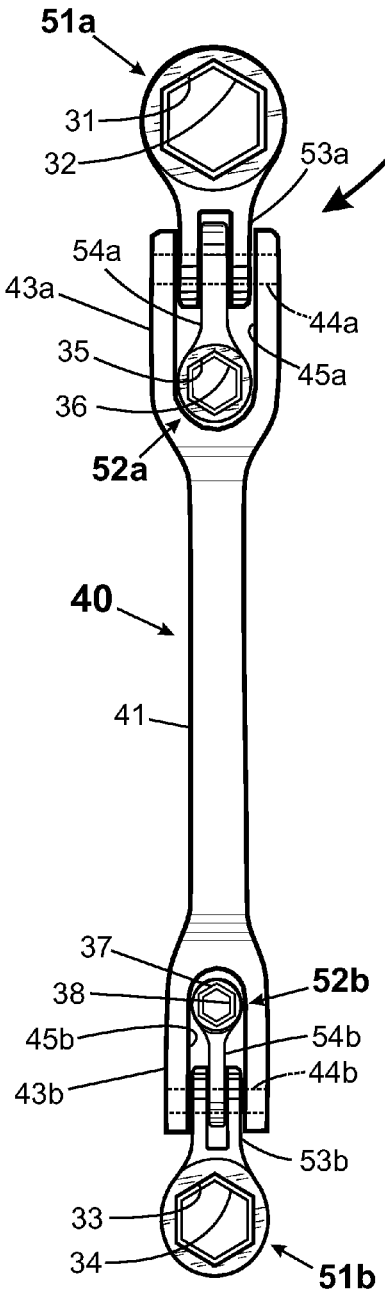

FIG. 3A Front View of the first embodiment (full wrench) seen partially in FIG. 2A-B.

Figure 3C:
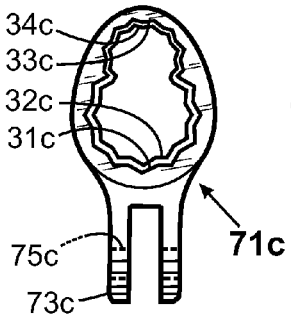
Figure 3D:
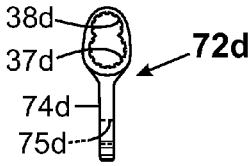
Figure 3E:
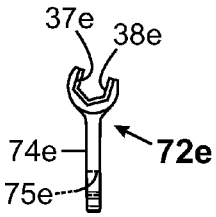
Figure 3B:
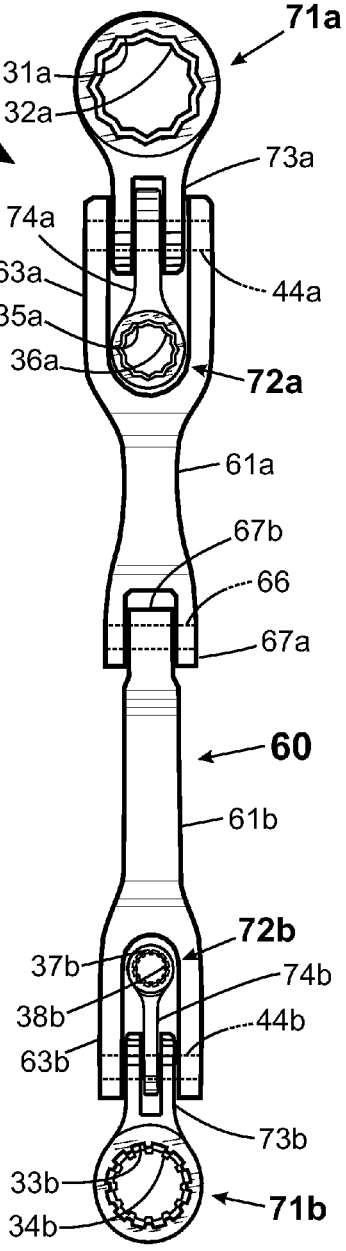

FIG. 3B Front View of third embodiment with two double nested wrench ends and a folding handle (extended).

FIG. 3C Front View of alternative wrench head assembly 71*c* with overlapped and duplexed gripping surfaces (standard twelve-point gripping surface).

FIG. 3D Front View of alternative wrench head assembly 72*d* with overlapped gripping surfaces with twelve-point spline gripping surfaces.

FIG. 3E Front View of alternative wrench head assembly 72*e* with open-end duplex wrench head.

FIG. 4A Side View of third embodiment with double nested wrench ends in its folded position.

Figure 4C:
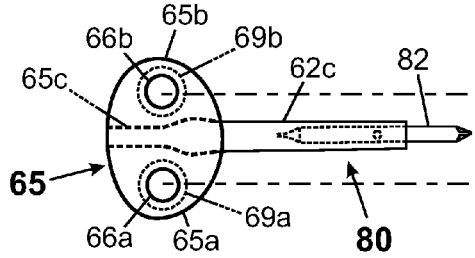
Figure 4D:
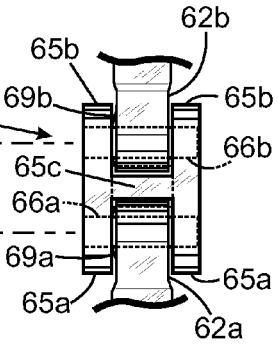
Figure 4B:
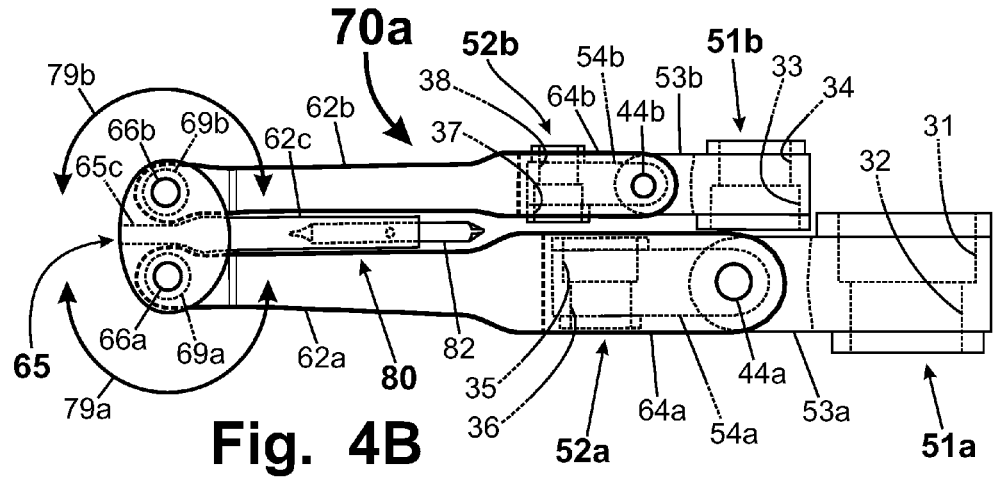

FIG. 4B Side View of fourth embodiment with double nested wrench ends and central hub.

FIG. 4C Side view of center hub 65 and attached screwdriver tool 80.

FIG. 4D Left end view of fourth embodiment with tool arms extended (screwdriver tool 80 is not shown in hidden lines to make the drawing easier to understand).

Figure 5:
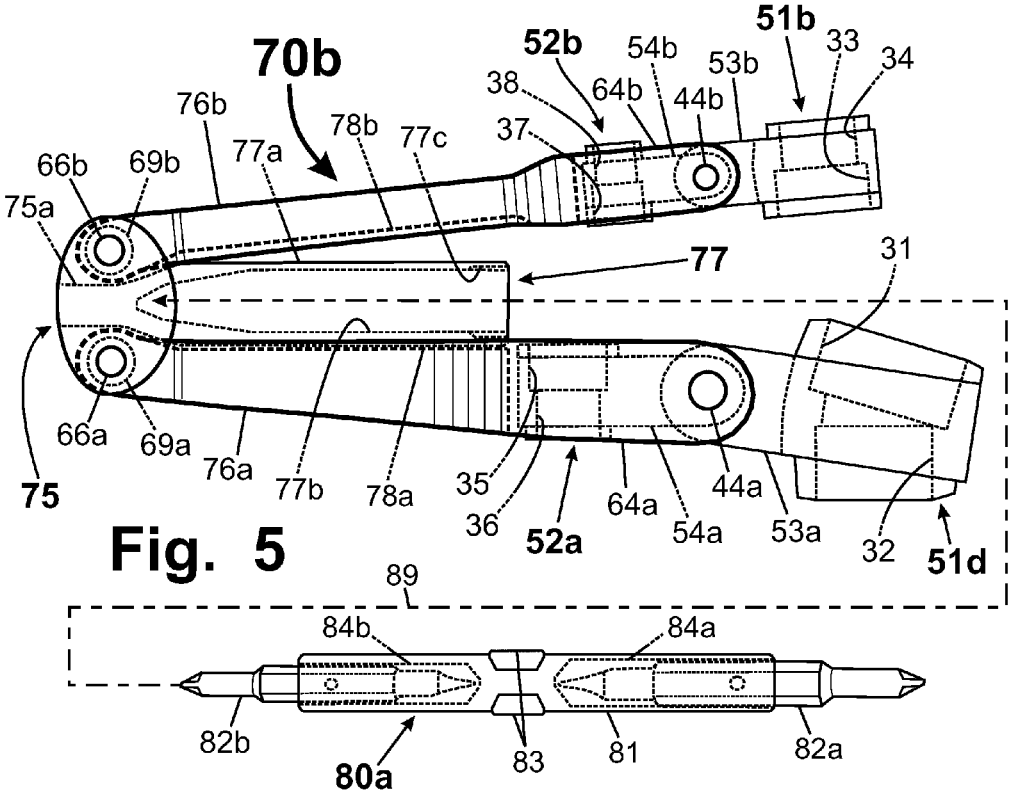

FIG. 5 Assembly view of fifth embodiment of a double nested wrench with a central hub and a reversible screwdriver assembly.

Figure 5A:
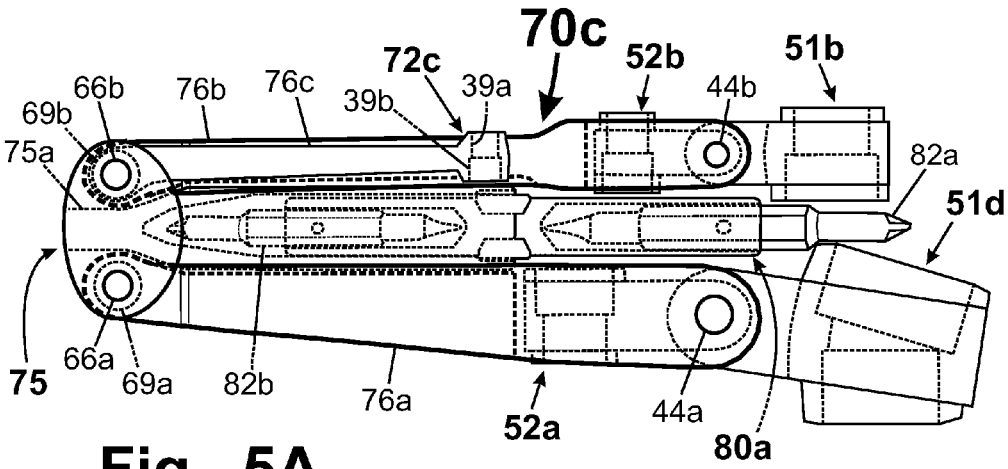

FIG. 5A Side view of a sixth embodiment comprising the tool assembly seen in FIG. 5 further including a third tool arm with a duplexed wrench head.

DETAILED DESCRIPTION OF THE INVENTION

All of the hand tools disclosed in this patent can be made of a hardened metal or metal alloy such as high carbon steel, chrome vanadium steel, stainless steel, titanium, aluminum, cobalt alloys, etc. The materials used to make the disclosed multitool are not limited to metals, and other materials like plastics and composite materials can be used depending on the tool. The standard manufacturing methods of drop forging and machining, injection molding, extrusion, etc. can be used here to manufacture the disclosed double nested wrench ends. The use of press fitted and/or screwed in hinge pins or pivot pins can provide assembly that is typical of existing wrenches and tools. Chrome vanadium steel can be used with all the disclosed wrenches and is used for wrenches, ratchets, sockets, screwdrivers, etc. because of its combination of relatively inexpensive cost, high strength, and good corrosion resistance. Standard tool manufacturing techniques can be used to construct the disclosed wrenches and hand tools. Hinge construction on these hand tools can comprise nearly any hinge structure that can support the torques and loads that will be applied perpendicular to the hinge axis during use. The folding hinges' axis can be oriented substantially perpendicular to the wrench heads' gripping surface axis so that the hinges do not need a locking mechanism in order for the user to transfer torque through the hinge to a rotary fastener. This means that when turning or rotating a fastener with a vertical rotational axis, the wrench's hinge(s) are oriented substantially parallel to the horizontal plane that is normal (perpendicular along two axes) to the fastener's rotational axis. A locking mechanism can be used on the folding hinges and the wrench heads' pivot hinges to prevent pivoting of the hinges during use, and any of the multitude of existing hinge locking and friction methods can be used.

In FIG. 1A, we see a sectioned perspective view of a prior art six-point duplex box-end wrench 20 with lobe style gripping surfaces 21 and 22. Wrench handle 23 supports duplex wrench head 20 comprising a small six-point lobe box-end wrench surface 21, a large six-point lobe box wrench surface 22, and a separator ring 24 for providing a wall between the small and large wrench sizes. Duplex wrench head 20 also angles the axis of gripping surfaces 21 and 22 slightly away from handle 23 so that the rotational axis of gripping surfaces 21 and 22 are no longer parallel. While surfaces 21 and 22 are shown only slightly angled in this example, present day technology often angles the axis of gripping surface 21 and 22 approximately fifteen degree away from perpendicular with the longitudinal axis of handle 23. This angle offset for each gripping surface is common for more ergonomic use of gripping surfaces 21 and 22. In the following examples the rotational axes of the gripping surfaces will be parallel, but the reader should realize that a forward angle is often placed on wrench gripping surface (see wrench head 51*d* in FIG. 5). For the disclosed designs, the wrench head assemblies have very short pivot arms which can approximately simulate the angling of the gripping surface axis on the end of the handle. This allows a user to easily turn a flush rotatory fastener on a flat or indented surface. Thus, the disclosed duplexed wrench heads for this invention are shown with parallel gripping surfaces, except for wrench head 20 in FIG. 1A), and wrench head 51*d* in FIG. 5. The other wrench heads disclosed here can have similar gripping surface axis angles if desired for a particular tool.

In FIGS. 1B and 1C, we see a front view and a side view, respectively, of a prior art duplex wrench head 20*a*. Pivot arm 23*a* provides a short arm length for wrench head 20*a* with a pivot hinge hole 26*a* for attachment on a pivot pin 26. Duplex wrench head 20*a* comprises a larger gripping surface 21*a* and a smaller gripping surface 22*a*. Both gripping surfaces 21*a* and 22*a* are shown with twelve point spline style gripping surfaces which have axes that are substantially parallel to each other (rotational axes coming out and into the page in FIG. 1B, and left and right in FIG. 1C). Gripping surfaces 21*a* and 22*a* come together near the middle of duplex wrench head 20*a* without a separator like separator 24 seen in FIG. 1A. A similar separator can be added to wrench head 20*a* to allow easier alignment of fasteners with the appropriate gripping surface.

In FIG. 1D, we see a prior art Figure Eight® wrench end 25 comprising two duplexed wrench heads 20*a* and 20*b* with pivot arms 23*a* and 23*b*, respectively, a pivot pin 26, a wrench handle 27 with a wrench handle hinge paw 28 having a wide hinge gap or opening 29. Pivot arms 23*a* and 23*b* are pivotally attached to hinge paw 28 with pivot pin 26 so that both pivot arms can rotate three-hundred sixty degrees in either direction around pivot pin 26. This full rotation of the wrench heads requires hinge opening 29 to be wide enough to allow larger duplex wrench head 20*a* to rotate through this opening. The disclosed double nested wrench end designs significantly reduces this width of the handle hinge paw (see width W1 in FIG. 2A) by splitting the pivot arm (hinge paw) of the larger wrench head to provide a space for the pivot arm of the smaller duplex wrench head. This provides good torque transfer for the larger wrench head while providing room for the smaller wrench head's pivot arm. This arrangement allows a much narrower hinge paw on the wrenches handle (see FIG. 2A) because the larger wrench head (see wrench head assembly 51*a*) does not need to rotate through the wrench handles hinge paw (see hinge paw gap 45*a*). This greatly reduced width of the handle's hinge paws while still allowing over three-hundred sixty degrees ofrotation for the smaller wrench head, but limits the rotation of the larger wrench head to less than three-hundred sixty degrees. During operation, this restriction of the rotation of the larger wrench head produces very little limitation on the usefulness of the wrenches since each side of both duplexed wrench heads can be rotated to nearly all the angles normally used in real life situations.

In FIGS. 2A, 2B, and 3A, we see a front view, right-side view, and a front view, respectively, of the first embodiment of the disclosed double nested wrench end. FIGS. 2A-B show the larger end of double nested wrench 50, while FIG. 3A shows the entire wrench 50 (two ends). In FIG. 3A, we see wrench 50 comprises a handle 40, two pivot pins 44*a-b*, two large duplex wrench head assemblies 51*a-b*, and two small duplex wrench assemblies 52*a-b*. Handle 40 comprises a handle body 41, a large handle hinge paw 43*a* on one end and a small handle hinge paw 43*b* on the other end. Each hinge paw 43*a-b* defines a paw gap 45*a-b*, respectively, between the hinge paw arms and are designed to allow smaller wrench heads 52*a-b*, respectively, to rotate through their respective gap area. With this design the diameter of wrench heads 51*a* can be significantly larger than the width W2 of the gap area 45*a* formed by hinge paw 43*a*. Similarly wrench head 51*b* can be significantly larger than the gap area 45*b* within hinge paw

43*b*. This can provide a significant reduction in width of the handle's hinge paws compared to prior art wrench end 25 seen in FIG. 1D for the same size gripping surfaces.

In FIGS. 2A-B and 3A, wrench head assembly 51*a* comprises a large gripping surface 31, a small gripping surface 32, and a pivotal hinge paw 53*a*. Wrench head assembly 52*a* comprises a large gripping surface 35, a small gripping surface 36, and a pivot arm 54*a*. Wrench head assembly 51*b* comprises a large gripping surface 33, a small gripping surface 34, and a pivotal hinge paw 53*b*. Wrench head assembly 52*a* comprises a large gripping surface 37, a small gripping surface 38, and a pivot arm 54*b*. The eight gripping surfaces sizes 31 through 38 are ordered in size from the largest to smallest, respectively. Each of the eight gripping surfaces are shown on wrench 50 as standard six point gripping surfaces for turning hex-head rotary fasteners. Other types of gripping surfaces can be easily substituted, as is illustrated in FIG. 3B, where standard twelve-point gripping surfaces are shown on the upper end of folding wrench 70, and twelve-point spline gripping surfaces are shown on the lower end of folding wrench 70. Wrench head assemblies 51*a-b* comprise a two arm hinge paws 53*a-b* for attachment to its respective pivot pins 44*a-b*. The width of wrench head pivotal hinge paws 53*a-b* (see width W2 for hinge paw 53*a* in FIG. 2A) can closely match the width of paw gap 45*a-b*, respectively. Each wrench head hinge paw 53*a-b* also defines a gap (see width W3 of gap on wrench head hinge paw 53*a* in FIG. 2A) between its hinge paw arms that allow pivotal attachment of pivot arms 54*a-b* of wrench heads 52*a-b* within hinge paw 53*a-b*, respectively. This allows arms 54*a-b* to be nested inside hinge paws 53*a-b*, respectively, and hinge paws 53*a-b* to be nested inside of handle hinge paws 43*a-b*, respectively on their respective pivot pins 44*a-b*. The overall width of the wrench head hinge paw 53*a* (see width W2) can be similar to the width of the pivot arm on a Craftsman's Figure Eight® wrench head of similar sized gripping surfaces (see arm 23*a* in FIG. 1D). This is because the outer portions of arm 23*a* provide most of the torque strength for turning gripping surfaces 21*a* and 22*a*. Thus, the arms of hinge paw 53*a* can provide nearly the same torque strength as solid arm 23*a* seen on Figure Eight® wrench 25, even though there is a significant gap (see width W3 in FIG. 2A) between the pivotal arms of hinge paw 53*a*.

In FIG. 2B, we see wrench 50 with wrench head assembly 51*a* having a range of rotation 59*a* and wrench head assembly 52*a* having a range of rotation 59*b*. On the smaller end of wrench 50 (see FIG. 3A), wrench head assembly 51*b* can have a similar range of rotation 59*a*, and wrench head assembly 52*b* can have a similar range of rotation 59*b*. The range of rotation 59*a* of wrench head 51*a* is limited to less than three-hundred sixty degrees because handle hinge paw 43*a* stops wrench head 51*a* from rotating completely around pivot pin 44*a*. The range of rotation 59*b* of wrench head 52*a* is limited to less than seven-hundred twenty degrees because even though it can pass through handle hinge paw 43*a* it is stopped from rotating further by wrench head 51*a*. In this particular design, wrench head 51*a* has a range of rotation that is approximately two-hundred seventy degrees, and wrench head 52*a* has a range of rotation that is approximately five-hundred forty degrees. These rotation ranges can be increased or decreased as needed by adjusting the shape of the hinge paws and wrench head assemblies. The center of rotation for wrench head 51*a* is in a vertical upward position as shown in FIGS. 2A-B, while wrench head 52*a* has its center of rotation vertically downward from pivot pin 44*a* as shown in FIG. 2A. This is in contrast to a Figure Eight® wrench 25 which provides space on its handle hinge paw 28 to allow both wrench heads 20*a-b* to rotate freely in either direction without limit (see FIG. 1D) though they cannot rotate past each other.

In FIG. 2B, the vertical height W4 of wrench head 51*a* is approximately equal to the diameter of gripping surface 31. This is a typical dimensional relationship between the vertical height of a duplex wrench and the diameter of its larger gripping surface. Single size wrench heads typically have vertical heights of approximately one-half their gripping surface diameter, or less, though these relationships very greatly from wrench to wrench. For example, in FIG. 4A, duplex wrench heads 71*b* and 72*b* are shown with a vertical height that is nearly twice the diameter of their larger gripping surfaces 34*b* and 37*b*, respectively. While duplex wrench heads 71*a* and 72*a* are shown with a vertical height significantly less than the diameter of their larger gripping surfaces 31*a* and 35*a*, respectively. Thus, the vertical height chosen for a particular duplex wrench head can be selected depending on its intended use, and can have values from a small fraction of its gripping surface diameter to well over two times its gripping surface diameter.

In FIG. 3A, we see all eight gripping surfaces 31 through 38 in order from largest to smallest, respectively. If we number these eight wrench sizes one through eight, with one being the largest size and eight being the smallest size, we see that the large end of wrench 50 has gripping surface sizes one, two, five and six, and the small end of wrench 50 has gripping surface sizes three, four, seven and eight. This combination of large duplex wrench head 51*a* with much smaller duplex wrench head 52*a*, and large duplex wrench head 51*b* with much smaller duplex wrench head 52*b*, allows for a narrower handle hinge paw because the gap area 45*a* only needs to be large enough to pass smaller wrench head assembly 52*a* through it. Also, a larger portion of hinge paw 53*a* can remain because the smaller size of wrench head assembly 52*a* allows a narrower pivot arm 54*a* so that gap W3 can be made relatively narrow and thus can allow width W2 of wrench head hinge paw 53*a* to be made more narrow than it might otherwise be. Thus hinge paw 43*a* can be significantly narrower than duplex wrench head 51*a*, something the Craftsman® Figure Eight® wrench cannot do because the larger duplex wrench head must pass through its handle's hinge paw. If alternatively, the four largest wrench sizes were mounted on one side of wrench 50 (wrench head assembly 51*a* and wrench head assembly 52*b* with substituted gripping surfaces 33 and 34) the width of the handle's hinge paw 43*a* would need to be increased to allow the new, larger, wrench head to pass through the hinge paw. At the same time with the four smallest wrench sizes (gripping surfaces 35, 36, 37, and 38) would still require the same size hinge paw 43*b* to allow wrench head 52*b* to rotate through hinge paw gap 45*b*. Thus, there is a significant size benefit for the disclosed double duplex wrench to match the two larger wrench head sizes with the two smaller wrench head sizes to minimize the width of the pivot hinges as shown.

In FIG. 2C, we see an alternative double nested wrench end 50*c* which is very similar to the large end of wrench 50 seen in FIGS. 2A-B. However, wrench end 50*c* comprises three duplex wrench head assemblies 51*c*, 52*a*, and 52*c*, a hinge paw 43*c* on handle 41*c*, and a pivot pin 44*c*. Wrench head assembly 52*a* can be identical to that wrench head assembly 52*a* seen in FIGS. 2A-B. Handle 41*c* and hinge paw 43*c* can be nearly identical to handle 41 and hinge paw 43*a*, respectively, but in this particular design handle hinge paw 43*c* is slightly wider than hinge paw 43*a* to accommodate larger width of wrench head pivot paw 53*c*. Wrench head assembly 51*c* can be nearly identical to wrench head 51*a* except that hinge paw 53*c* on wrench head assembly 51*c* is slightly wider than hinge paw 53*a* on wrench head assembly 51*a* to accommodate the attachment of pivot arm 54*c* of wrench head assembly 52*c* within hinge paw 53*c* of wrench head assembly 51*c*. If pivot arm 54*c* of wrench head assembly 52*c* is mounted on pivot pin 44*c* outside the larger wrench head's hinge paw (next to handle hinge paw 43*c*) then wrench head assembly 51*a* can be used instead of assembly 51*c* without loss in functionality. Wrench head assembly 52*c* comprises two duplexed gripping surfaces 39*a* and 39*b*, and a curved pivot arm 54*c*. Gripping surfaces 39*a-b* can have the ninth and tenth sizes (the next two sizes smaller than gripping surface 38) for a complete ten-size wrench set. Notice that gripping surfaces 39*a-b* are shown four sizes smaller than gripping surfaces 35 and 36, respectively, and gripping surfaces 35 and 36 are four sizes smaller than gripping surfaces 31 and 32, respectively. If one, or both, ends of wrench 50 (see FIG. 3A) where to use this style of three wrench head tool end, wrench 50 could support ten or twelve wrench sizes, respectively.

In FIG. 2C, the range of rotation of wrench head assembly 52*c* can be similar to the range of rotation of wrench head assembly 52*a* in both cases (pivot arm 54*c* inside as shown or outside hinge paw 53*c* next to handle hinge paw 43*c*), because wrench head assembly 52*c* cannot pivot past wrench head assembly 51*c* even if its handle is located outside hinge paw 53*c* (or a substituted hinge paw 53*a*). Also notice that other additional pivotal tools can be attached to pivot pin 44*c* if desired by simply increasing the width of handle hinge paw 43*c* and pivot pin 44*c*.

In FIGS. 3B and 4A, we see folding wrench 70, which is very similar to wrench 50, but includes a folding hinge handle assembly 60 instead of a fixed handle 40, and has different styles of wrench gripping surfaces. Folding wrench 70 comprises four duplex wrench head assemblies 71*a*, 71*b*, 72*a*, and 72*b* in order of largest to smallest, and a folding handle assembly 60. Wrench head assembly 71*a* comprises gripping surfaces 31*a* and 32*a*, and a pivotal hinge paw 73*a*. Wrench head assembly 71*b* comprises gripping surfaces 33*b* and 34*b*, and a pivotal hinge paw 73*b*. Wrench head assembly 72*a* comprises gripping surfaces 35*a* and 36*a*, and a pivot arm 74*a*. Wrench head assembly 72*b* comprises gripping surfaces 37*b* and 38*b*, and a pivot arm 74*b*. Folding handle assembly 60 comprises a large folding handle 61*a*, a small folding handle 61*b*, and a hinge pin 66. Large folding handle 61*a* comprises a large handle hinge paw 63*a*, and a folding hinge paw 67*a*. Small folding handle 61*b* comprises a small handle hinge paw 63*b* and a hinge post 67*b*. The folding hinge comprises hinge paw 67*a*, hinge post 67*b*, and hinge pin 66. Hinge pin 66 pivotally connects hinge paw 67*a* to hinge post 67*b* so that arms 61*a* and 61*b* can fold substantially next to or adjacent (longitudinally adjacent) each other to provide a compact stowed position for wrench 70 (see FIG. 4A), and substantially apart from each other to provide an extended position for use. Range of motion arrows 79 show the approximate range of motion of folding handle 61*b* with respect to folding handle 61*a*. Gripping surfaces 31*a*, 32*a*, 33*b*, 34*b*, 35*a*, 36*a*, 37*b*, and 38*b* on wrench 70 can have substantially the same grip sizes as gripping surfaces 31 through 38 on wrench 50, respectively. However, wrench 70 has different gripping surface styles, where gripping surfaces 31*a*, 32*a*, 33*b*, and 34*b* have twelve-point standard gripping surfaces, and gripping surfaces 35*a*, 36*a*, 37*b*, and 38*b* have twelve-point spline gripping surfaces. Because wrenches 50 and 70 have common sized gripping surfaces they can both provide similar functionality. However, wrench 70 also provides folding handle 60 which allows it to fold to a stowed position; something wrench 50 cannot do.

In FIG. 4A, we see wrench 70 folded in its stowed position with handles 61*a* and 61*b* longitudinally adjacent each other, and wrench head assemblies 71*a* and 72*a* longitudinally adjacent wrench head assemblies 71*b* and 72*b*. Wrench head assemblies 71*a* and 72*a* have duplexed wrench heads that have a vertical height approximately equal to the diameter if their respective gripping surface. This provides compact stowage of the wrench when the wrench head assemblies are pivoted inline with handle 61*a* as shown. Wrench head assemblies 71*b* and 72*b* have higher vertical profiles with vertical heights that can be greater than twice the diameter of their respective larger gripping surface. To allow better folding of the wrench, the vertical height of wrench head assemblies 71*a-b* and 72*a-b* can be kept to a minimum. However, for some purposes, deeper wrench head gripping surfaces are needed. The duplexed wrench heads of assemblies 71*b* and 72*b* have extended gripping surfaces, so that each wrench size can reach into indentations to turn rotary fasteners. This arrangement gives gripping surfaces 33*b* and 34*b* a combined vertical height that is just over two times the diameter of gripping surface 33*b*. Similarly, gripping surfaces 37*b* and 38*b* have a combined vertical height that is just over two times the diameter of gripping surface 37*b*. The larger vertical height of wrench head 71*b* could cause problems when folding for stowage because of its size. However, the end of gripping surface 34*b* is positioned so that it can fold down into the cavity formed by gripping surface 31*a* to provide a compact folded, and stowed position. This makes it easier to slip wrench 70 into ones pocket (pocket ready). Arms 61*a* and 61*b* can fold substantially parallel to each other because hinge paw 67*a* and hinge post 67*b* are slightly angled from the rest of its respective handle (see left side of FIG. 4A). These slight angling allows room for handles 61*a-b* to fold longitudinally adjacent each other as shown in FIG. 4A.

In FIG. 4A, wrench 70 is drawn approximately to scale for a wrench set with gripping surface sizes from 13/16 inch to 3/8 inch in 1/16 inch increments. This gives wrench 70 approximately a six inch folded length (stowed position, see FIG. 4A) and approximately a twelve inch extended length (extended position, see FIG. 3B—Not to scale). The user can grip the wrench around pivot pins 44*a-b* to apply torque to gripping surfaces on the other end of the wrench. In alternate designs, the length of arms 61*a-b* can be made shorter to provide a more compact wrench when folded to a stowed position, or where the higher torques provided by a longer wrench are not needed.

As we see in FIG. 4A, large handle hinge paws 63*a* along with wrench head assemblies 71*a* and 72*a* can provide a wider pivotal range than wrench head assemblies 51*a* and 52*a*, respectively, seen in FIG. 2B, because of the lower profile (smaller vertical height) of wrench heads 71*a* and 72*a*. Wrench head assembly 71*a*, can pivot to position 71*y* (shown in shadow lines) when fully rotated clockwise against hinge paw 63*a* on handle 61*a*. With the larger wrench head assembly 71*a* in position 71*y*, smaller wrench head assembly 72*a* can be rotated approximately two-hundred seventy degrees clockwise to position 72*y* (shown in shadow lines) against wrench head assembly 71*a* to use gripping surface 36*a*. If wrench head assembly 71*a* is instead fully rotated counter-clockwise (position not shown), wrench head assembly 72*a* can rotate two-hundred seventy degrees counter-clockwise from its shown position to use gripping surface 35*a*. Wrench head assemblies 71*b* and 72*b*, because of their larger vertical height, have slightly smaller pivotal ranges than wrench head assemblies 71*a* and 72*a*, respectively, as well as, smaller pivotal ranges than wrench head assemblies 51*b* and 52*b*, respectively. Thus, many different combinations of vertical height can be used to provide the desired functions for a double nested wrench. For example, the small vertical heights for wrench heads 71*a* and 72*a* allow the wrench head positions shown by 71*y* and 72*y*, respectively. This position allows the axis of gripping surface 36*a* to be substantially parallel to the longitudinal axis of arm 61*a* (see position 72*y*). This can allow one to use the wrench somewhat like a screwdriver, with folded handles 61*a-b* acting as the handle for the wrench gripping surface 36*a*. Handle 61*b* can also be pivoted ninety degrees around hinge pin 66 so that it is substantially perpendicular to handle 61*a* to provide a short handle for the user to apply torque along the axis of gripping surface 36*a* (pivoted to position 72*y*) or 35*a* (pivoted opposite position 72*y*). Thus, many different modes of operation are possible for these double nested wrenches depending on how they are constructed. These modes of operation can include a short handle mode (exposed gripping surfaces used in their stowed position), a long handle mode (handles folded out to and extend position), a screwdriver mode (wrench head axis or tool axis pivoted inline with its handles with the handles used as the screwdriver hand grip), a driver handle mode (one handle angled substantially perpendicular to the other handle and perpendicular to the axis of the gripping surface being used), a double handled mode (requires central hub and elongated tool on central hub) and various angled modes in-between these modes. Similar modes exist on the other example folding double nested wrenches presented here.

In FIGS. 3C, 3D, and 3E, we see three alternative wrench head assemblies 71*c*, 72*d*, and 72*e*, respectively. Wrench head assembly 71*c* can be substituted directly for wrench head assemblies 51*a* and 71*a* on pivot pin 44*a* of wrench hand tools 50, 70, 70*a*, and 70*b*. Similarly, alternative wrench head assemblies 72*d* and 72*e* can be substituted for either wrench head assemblies 52*b* and 72*b* on pivot pin 44*b* of wrench hand tools 50, 70, 70*a* and 70*b*. In FIG. 3C, we see wrench head assembly 71*c* comprising an overlapped and duplexed wrench head with four gripping surface sizes 31*c*, 32*c*, 33*c*, and 34*c*, and a pivotal hinge paw 73*c* with a pivot hole 75*c* passing therethrough. Hinge paw 73*c* on wrench head assembly 71*c* can be substantially the same as hinge paw 53*a* seen on wrench head assembly 51*a* or hinge paw 73*a* seen on wrench head assembly 71*a*. Thus, wrench head assembly 71*c* can be mounted on wrench hand tools 50, 70, 70*a* and 70*b* with pivot hole 75*c* pivotally attached to pivot pin 44*a*. Wrench head assembly 71*c* shows how alternate wrench head designs can be used to provide greater numbers of wrench sizes in a double nested wrench design. If all four wrench head assemblies 71*a-b* and 72*a-b* were replaced with overlapped duplex wrench heads like wrench head 71*c*, wrench hand tools 50, 70, 70*a* or 70*b* could provide sixteen separate wrench sizes (four sizes each times four wrench heads) for the user. If a third pivotal wrench head assembly, like wrench head assembly 52*c*, were added to each end of wrench hand tools 50, 70, 70*a* or 70*b*, a total of twenty wrench sizes are possible, and twenty-four wrench sizes if both additional wrench heads also have overlapped duplex wrench heads.

In FIG. 3D, we see alternative wrench head assembly 72*d* comprising two overlapped wrench gripping surfaces 37*d* and 38*d*, and a pivot arm 74*d* defining a pivot hole 75*d* for mounting on pivot pin 44*b* of wrench hand tools 50, 70, 70*a* or 70*b*. Pivot arm 74*d* can be substantially the same as pivot arm 54*b* or 74*b* on wrench head assembly 52*b* or 72*b* respectively. Thus, wrench head assembly 72*d* is designed so that it can replace wrench head assembly 52*b* on wrench hand tools 50, 70*a*, and 70*b*, or wrench head assembly 72*b* on wrench 70. Wrench head assembly 72*d* shows how alternate wrench head designs can be used to provide different wrench gripping surface configurations for disclosed double nested wrench, while still providing multiple gripping surfaces on a single pivotal wrench head. Both the overlapped duplex wrench head 71*c* and overlapped wrench head 72*d* can be modified to provide two, three, four, or more different gripping surface sizes depending on their design.

In FIG. 3E, we see wrench head assembly 72*e* comprising an duplexed open-end wrench head with open-end gripping surfaces 37*e* and 38*e*, and a pivot arm 74*e* defining a pivot hole 75*e* for mounting on pivot pin 44*b* of wrench hand tools 50, 70, 70*a* or 70*b*. Pivot arm 74*e* can be substantially the same as pivot arms 54*b* or 74*b* discussed previously. Thus, wrench head assembly 72*e* can be designed so that it can replace wrench head assembly 52*b* on wrench hand tools 50, 70*a*, and 70*b*, or wrench head assembly 72*b* on wrench 70. The use of open ended wrenches, like wrench head 72*e*, can allow the user to get to rotary fasteners that can only be reached from the side. The above three alternative wrench head assemblies 71*c*, 72*d*, and 72*e* are just a few of the possible alternative multiple gripping surface wrench head designs that can be use with disclosed pivotal double nested wrench ends.

In FIG. 4B, we see wrench hand tool design 70*a* comprising a central hub 65, a large folding wrench handle 62*a* with a pivot pin 44*a* for pivotally mounting two wrench head assemblies 51*a* and 52*a* on a large folding handle hinge paw 64*a*, a small folding wrench handle 62*b* with a pivot pin 44*b* for pivotally mounted two wrench head assemblies 51*b* and 52*b* on a small handle hinge paw 64*b*, and a screwdriver tool assembly 80. Hand tool 70*a* can also be referred to as a wrench, because in addition to a screwdriver tool 80, a full set of wrench sizes 31 through 38 are provided. Wrench handle 62*b* is slightly shorter than handle 61*b* seen in FIG. 4A, so that the portion of wrench head 51*b* housing gripping surface 33 can fold down against pivotal hinge paw 53*a* of wrench head 51*a*, and provide a more compact stowed position. Hinge paws 64*a-b* can be the same or similar to hinge paws 63*a-b*, respectively. In FIG. 4C, central hub 65 can be seen separated from handles 62*a-b*, and comprising a larger hinge paw 65*a*, a smaller hinge paw 65*b*, a central support member 65*c*, a large hinge pin 66*a*, a small hinge pin 66*b*, a large friction spring disc 69*a*, a small friction spring disc 69*b*, and a screwdriver arm 62*c* integrated with central support member 65*c*. In alternate designs, screwdriver arm 62*c* can be pivotally mounted to central hub 65 with a separate hinge pin through central hub 65. Screwdriver assembly 80 comprises a screwdriver tool arm 62*c* and a double ended screwdriver bit 82 designed for reversible mounting on the end of screwdriver arm 62*c*. Handle 62*a* is pivotally mounted to large hinge paw 65*a* on central hub 65 with hinge pin 66*a*, and friction disc 69*a* positioned between the end of handle 62*a* and the inside of hinge paw 65*a*. Friction disc 69*a* presses on both handle 62*a* and hinge paw 65*a* to provide friction to help hold handle 62*a* in a particular position with respect to hub 65 during use. Handle 62*b* is pivotally mounted to central hub 65 with hinge pin 66*b*, and friction disc 69*b* positioned between handle 62*b* and hinge paw 65*b*. Friction disc 69*a* presses on both handle 62*b* and hinge paw 65*b* to provide friction to help hold handle 62*b* in a particular position with respect to hub 65 during use. Handles 62*a* and 62*b* are each designed to rotate approximately one-hundred eighty degrees from their shown position in FIG. 4B. Center support member 65*c* can provide a stop in both directions for handles 62*a-b*. Wrench heads 51*a-b* and 52*a-b* on hand tool 70*a* can be attach, and function, similar to those previously discussed in wrench 50.

In FIGS. 4B and 4C, screwdriver tool 80 is seen integrated with central hub 65, where screwdriver arm 62*c* can be formed by, forging, welding, screwing, pressure fitting, riveting, or otherwise attaching it to central hub 65. With this arrangement, reversible screwdriver assembly 80 is fixed in relationship to central hub 65 during use. Handle 62*a* can be rotated one-hundred eighty degrees away from screwdriver 80 in the clockwise around hinge pin 66*a* (see range of rotation 79*a*). Similarly, handle 62*b* can be rotated one-hundred eighty degrees away from screwdriver assembly 80 in the counter-clockwise around hinge pin 66*b* (see range of rotation 79*b*). This allows both handles to pivot away from screwdriver assembly 80 as shown by range of rotation arrows 79*a-b*, allowing wrench heads 51*a* and 52*a* to fold together with wrench heads 51*b* and 52*b* on the opposite side of central hub 65. In this unfolded position, central support member 65*c* can provide a stop for both handles 62*a-b* so that hub 65 and screwdriver arm 62*c* is locked in place substantially parallel to handles 62*a-b* when the user grasps handles 62*a-b* and their respective wrench head assemblies. This allows the entire wrench to function effectively as a stiff screwdriver, with handles 62*a* and 62*b* acting as the screwdriver hand grip (handle).

In FIG. 5, we see an alternative double nested wrench hand tool 70*b* which is very similar to hand tool 70*a*. Hand tool 70*b* can be constructed from hand tool 70*a* by replacing central hub 65 on hand tool 70*a* with an expanded central hub 75, replacing handles 62*a-b* with a pair of folding wrench handles 76*a-b*, respectively, replacing screwdriver arm 62*c* with a screwdriver arm 77, replacing screwdriver bit 82 with a reversible screwdriver assembly 80*a*, and replacing wrench head assembly 51*a* an angled wrench head assembly 51*d*. The remainder of hand tool 70*b* can be the same as seen in hand tool 70*a* in FIG. 4B. Central hub 75 has been expanded in height to increase the spacing between hinge pins 66*a-b* and to provide folding handles 76*a-b* with a larger enough space between them to fold comfortably to the sides of screwdriver arm 77 and screwdriver assembly 80*a*. Central hub 75 comprises a support member 75*a*, a pair of hinge pins 66*a-b*, a pair of friction discs 69*a-b*, and screwdriver arm 77. Support member 75*a* connects the two sides of central hub 75 together and provides an "H" shaped structure (see similar hub 65 in FIG. 4D) to provide two hinge paws for pivotally mounting handles 76*a-b* on hinge pins 66*a-b*, respectively. Hinge pins 66*a-b* and friction discs 69*a-b* provide the same structure and function as they did in hand tool 70*a*. Screwdriver arm 77 can be an integral part of central hub 75 and comprises a screwdriver arm body 77*a* and an attachment channel 77*b* defining a pair of connecting slots 77*c*. Handles 76*a-b* are pivotally attached to hinge pins 66*a-b* respectively, and each define a groove 78*a* and 78*b* respectively, which provide added space for screwdriver arm 77, and allows hand tool 70*b* to fold more compactly for stowage as shown.

In FIG. 5, screwdriver assembly 80*a* comprises a screwdriver body 81, two reversible double-ended screwdriver bits 82*a-b*, two connector tabs 83, and two attachment ports 84*a-b*. Attachment ports 84*a-b* are designed for removable attachment to either end of screwdriver bits 82*a-b*, respectively. Both ends of screwdriver assembly 80*a* can be inserted into screwdriver arm 77 as shown by construction line 89. When inserted, screwdriver body 81 engages attachment channel 77*b*, and tabs 83 engaging slots 77*c* to allows torque to be transferred from hub 75 to screwdriver body 81 and ultimately to any one of the ends of screwdriver bits 82*a-b*. Because, both double ended screwdriver bits 82*a-b* are reversible, and screwdriver body 81 is reversible, all four screwdriver bit ends can be used by the user simply by selecting which screwdriver bit end they want to use. Screwdriver body 81 can be designed with hex head attachment ports 84*a-b* (standard six point wrench gripping surface) that can also be used for turning rotary fasteners (when its respective screwdriver bit is removed). With this type of reversible screwdriver body 81 attachment ports 84*a-b* can be shaped to provide two additional gripping surface sizes. For example, attachment port 84*a* can be given a six-point hex head shape and provide a wrench size of 5/16 inch, or 7 mm. Similarly, attachment port 84*b* can be given a six-point hex head shape and provide a wrench size of 1/4 inch, or 6 mm. By doing this, hand tool 70*b* can have a total of ten wrench sizes (e.g. 1/4", 5/16", 3/8", 7/16", 1/2", 9/16", 5/8", 11/16", 3/4", and 13/16"—or—e.g. 6 mm, 7 mm, 8 mm, 9 mm, 10 mm, 12 mm, 14 mm, 15 mm, 17 mm, and 19 mm). Where gripping surfaces 31 through 38 provide the wrench sizes 3/8" to 13/16", respectively, or 8 mm to 19 mm, respectively. These two examples for hand tool 70*b* represent only a tiny sampling of the many different wrench styles, gripping surface types, gripping surface sizes, wrench head vertical heights, and choice of additional tools that can be combined in hand tool 70*b*.

In FIG. 5, screwdriver arm 77 and screwdriver assembly 80*a* is shown between wrench handles 76*a* and 76*b* for stowage. Handles 76*a-b* each can be folded out one-hundred eighty degrees to use screwdriver assembly 80*a*. In alternate designs, screwdriver arm 77 and assembly 80*a* can be mounted to the side of wrench handles 76*a-b* so that the spacing between hinge pins 66*a* and 66*b* on central hub 75 can be similar to the spacing seen on central hub 65 in FIG. 4A, or even narrower. In order to do this, screwdriver arm 77 and assembly 80*a* can be positioned out from between handles 76*a-b* to the side, with arm 77 mounted on the front side of central hub 65 (e.g., attaching arm 77 to hub surface facing the reader in FIG. 5) so that screwdriver arm 77 and assembly 80*a* can rest along the side handles 76*a-b* instead of between them. This allows handles 76*a-b* and screwdriver arm 77 to fold substantially parallel and adjacent each other forming a somewhat triangular arrangement of handles 76*a-b* and arm 77 when viewed form the end. This arrangement can provide a compact stowed position.

In FIG. 5, wrench head assembly 51*d* comprises two angled gripping surfaces 31 and 32, which can be the same size and shape as gripping surfaces 31 and 32 seen in wrench head assembly 51*a*. However, in wrench head assembly 51*d*, gripping surfaces 31 and 32 are angled approximately fifteen degrees further away from pivot arms of hinge paw 53*a* than on wrench head assembly 51*a*. This can make it slightly easier to reach a rotary fastener than having parallel axis gripping surfaces (see wrench head assemblies 51*a-c*, 52*a-b*, 71*a-b* and 72*a-b*). However, since the length of hinge paw 53*a* is so short, most of the advantages from having an angled gripping surface axis, such as that seen on wrench head assembly 51*d*, can be achieved by pivoting wrench head 51*a* around pivot pin 44*a* (see FIGS. 2A and 2B).

In FIG. 5A, we see a side-view of a folding wrench hand tool 70*c* in its folded or stowed position. Hand tool 70*c* is very similar to hand tool 70*b*, but comprises an additional duplexed wrench head 72*c* and a tool arm 76*c*. Duplex head 72*c* can comprise two wrench gripping surfaces 39*a* and 39*b* which are attached to one end of tool arm 76*c*. This provides a total of ten different wrench sizes for folding hand tool 70*c* not including the two additional socket sizes that can be provided by attachment ports 84*a* and 84*b*. In alternate designs, a double nested wrench end (a smaller version of hinge paw 64*b* and duplex wrench heads 51*b* and 52*b*) can be used with arm 76*c* to provide twelve wrench sizes for hand tool 70*c* plus and additional two socket sizes from ports 84*a-b* for a total of fourteen different wrench sizes plus four screwdriver bit sizes in a single tool. Connection ports 84*a* and 84*b* can be made to fit 5/16 inch and 1/4 inch hexagon shaped rotatory fasteners, respectively, or alternatively, different gripping surface sizes and/or different gripping surface types can be used. Additional wrench arms with various wrench heads can be added to hand tool 70*c* in a similar manner.

Wrench arm 76*c* is pivotally attached to central hub 75 with hinge pin 66*b* at the end opposite wrench head 72*c*. This allows arm 76*c* to pivot independently of tool arms 76*a-b* through an angle of approximately one-hundred eighty degrees, similar to the pivotal action of tool arm 76*b*. Arm 76*c* and wrench head 72*c* can be pivoted up to one-hundred eighty degrees counter-clockwise from the position seen in FIG. 5A to a substantially extended position for use. This allows handles 76*a-b* and tool heads 51*b*, 51*d* and 52*a-b* to be used as the wrench handle for gripping surfaces 39*a-b*. Central hub 75 can be the same as seen in FIG. 5. In this particular design the pivotal end of arm 76*b* (at hinge pin 66*b*) has been narrowed slightly so that the pivotal end of arm 76*c* can be inserted into hub 75 adjacent handle 76*b*. In alternate designs, hub 75 can be widened to allow both of the unmodified pivotal ends of tool handles 76*b* and 76*c* to be pivotally mounted. Alternatively, an additional tool arm can be added in a similar manner to the larger arm hinge (hinge pin 66*a*) to provide even more gripping surface sizes for tool 70*c*.

Operational Description (FIGS. 2B, 3A-B, and 4A-B)

All the hand tools presented in this patent operate generally in the same way, with some of the examples have added functions that make their design unique. Also, with the addition of a folding handle, the hand tools can have an extended and stowed positions, as well as, additional operational positions, and operational functions. If additional tools besides wrench tools are attached to the disclosed hand tools then additional operational modes exist to use these additional tools.

Individual wrenches, with a single wrench size, can be used with the double nested wrench tools presented in this patent, but this can limit its advantages by not allowing a full set of eight or more wrench sizes to be combined into a single hand tool. Thus, all the examples presented here use wrench heads that provide two or more sizes for each wrench head to maximize functionality. However, nothing prevents single gripping surface wrenches from to be used for some or all of the pivotal wrench heads, if needed for a specific purpose. For most of the examples presented here, duplex wrench heads are shown, but many other types of multiple gripping surface wrench heads can be substituted for the duplexed wrench heads. Thus, wrench heads with both overlapped and/or duplexed gripping surfaces (see FIGS. 3C-E) can be used to enhance the functionality of the disclosed wrench hand tools. Specifically, this can be useful when providing a full set of both metric and standard wrenches in a single wrench, where using overlapped duplex wrench heads (four sizes each, see FIG. 3C) can provide sixteen or more wrench gripping surface in metric and standard sizes.

The disclosed double nested wrench head ends can be made more ergonomic by adding tools other than wrenches. For example, hand tools 70*a* and 70*b* both incorporate a multi-sized screwdriver to provide added functionality. Other tools can be added or substituted for the screwdrivers shown. The operation of multiple sized wrench heads is slightly differently than single sized wrenches, but are well understood. Duplexed wrenches can have a different gripping surface size on each side of the wrench head, such that, each side can be used to engage a rotary fastener of a different size. The actual act of using the wrench head amounts to nothing more than engaging a rotary fastener with a wrench's gripping surface of similar size and turning the wrench handle. Such tool operation is well understood by most people. However, the addition of double nested pivotal wrench heads changes the way the wrench heads can be angled, and will be discussed further.

The disclosed double nested wrenches (tool handle and double nested tool head combination) can be placed in any or all of seven functional positions: 1) a folded and stowed position for stowage (see wrench hand tools 70, 70*a*, and 70*b*), 2) a short handle operational position(s) where some or all of the wrench sizes can be used while in the stowed position (see wrench hand tools 70*a* and 70*b*), 3) an long handle, or extension handle position, for use of the wrench heads (all wrenches, see FIGS. 3A and 3B), 4) a crank handle position (see FIG. 4A), 5) a short handle with tool extension position (see FIG. 4A), 6) an additional tool's operational position (non-wrench tools, see FIGS. 4B and 5), 7) various angled positions for the wrench heads (see FIGS. 2B and 4A), and each position above having various angled positions for the tool handles (see FIGS. 4A-B and 5). Because of the variety of angles possible for the wrench heads and folding handles, these hand tools disclosed here can simulate a number of curved and strangely shaped wrenches. The specific operation of the hand tools depend greatly on the arrangement of tool handles and the placement of the pivotal wrench heads. In the designs presented here, the "extended handle position" on one side of a wrench can also be an "extended operational position" when the user grips the opposite side of the wrench. The "short handle position" or "stowed position" are not available for some hand tools because they lack a folding hinge.

Hand Tool Operation

The operational use of wrenches and other hand tools is common knowledge. For use of wrenches, the wrench gripping surface is placed in contact with the rotary fastener's head and torque is applied to the wrench handle to turn the fastener. For other tools such as hammers, screwdrivers, pry bars, and others, most people already know how to use these tools even if other pivotal handles are surrounding them. Also, it is somewhat intuitive to pivot a particular tool away from the main body of the hand tool for use, such as in a folding knife, or folding allen wrench set, etc. Thus, the use of the disclosed folding wrenches is similarly very intuitive. However, because of the multitude of possible configurations for the tool handles, a few specific examples will be discussed here to ensure understanding.

Prior Art Operation (FIGS. 1C-D)

In FIG. 1D, Figure Eight® wrench 25 is shown with wrench head assembly 20*a* extended for use. Gripping surfaces 21*a* and 22*a* can be used in this position depending on which side of wrench head 20*a* is engaged against a fastener. To use wrench head assembly 20*b*, both wrench head assemblies 20*a* and 20*b* can be pivoted around pivot pin 26 to exchange places. With wrench head 20*b* extended away from hinge paw 28, its gripping surfaces can be used. Wrench head assemblies 20*a-b* can be rotated to many other angles depending on the needed orientation of the wrench head. Both assemblies 20*a-b* can pivot around pivot pin 26 continuously in either direction, but neither assembly can rotate past the other. Thus, the Figure Eight® wrench can pivot its two wrench head assemblies 20*a-b* to any angle desired.

Operation of Double Nested Wrench (FIGS. 2A-B, 2C, and 3A)

In FIGS. 2A and 2B we see one end of wrench 50 with two wrench head assemblies 51*a* and 52*a* mounted on hinge paw 43*a* with pivot pin 44*a*. Large wrench head 51*a* is nested pivotally inside handle hinge paw 43*a*, and small wrench head 52*a* is nested pivotally inside hinge paw 53*a* on wrench head 51*a* (double nested). Unlike the Figure Eight® wrench, the gap 45*a* (width W2) in handle hinge paw 43*a* is significantly smaller than the tool end of wrench head assembly 51*a*, so that wrench head 51*a* cannot pass through gap 45*a* on handle hinge paw 43*a*. This prevents wrench head 51*a* from pivoting a full three-hundred sixty degrees around pivot pin 44*a*. In FIG. 2B we see that wrench head 51*a* can pivot clockwise until it encounters the right side of hinge paw 43*a* at position 51*y*. Wrench head 51*a* can also pivot counter-clockwise to a similar position on the left side of hinge paw 43*a*. Thus, wrench head 51*a* has a range of rotation 59*a* that can be approximately two-hundred seventy degrees. Smaller wrench head assembly 52*a* is pivotally nested inside hinge paw 53*a* on wrench head 51*a* and pivotally attached to pivot pin 44*a*. This nesting arrangement means that wrench head 52*a* cannot rotate past wrench head assembly 51*a*, and thus has a limited range of rotation 59*b* around pivot pin 44*a* even though it can rotate freely through handle hinge paw gap 45*a*. Because wrench head 52*a* is small enough to pass through gap 45*a* in hinge paw 43*a*, it can pivot to either side of wrench head 51*a*. The result of this is that both wrench heads 51*a* and 52*a* can pivot to the same useful orientations as a Figure Eight® wrench, but without the oversized wrench handle hinge paws of the Figure Eight® wrench. Thus, the double nested wrench design can provide nearly all the functionality of a Figure Eight® wrench, but with a handle hinge width W1 that is significantly small than a Figure Eight® wrench with similarly sized gripping surfaces.

In FIGS. 2A-B and 3A, the width of hinge paw 43*a* (width W1), on wrench handle 41, is made smaller than a double nested wrench design with the large wrenches on one side and the small wrenches on the other. This can be done by skipping two gripping surface sizes between gripping surfaces 31 and 32 on wrench head 51*a* and gripping surfaces 35 and 36 on wrench head 52*a*. The gripping surface sizes 33 and 34 are moved to the opposite end of wrench 50, where the width of handle hinge paw 43*b* can be determined by the width of the smallest duplex wrench head assembly 52*b*. If instead the four largest gripping surfaces 31 through 34 where all put on the same side of wrench 50 (duplex wrench head 52*a* having gripping surfaces 33 and 34), the width of hinge paw 43*a* would have to be made significantly larger to allow a wrench head having gripping surfaces 33 and 34 to pass through the wrench handle's hinge paw (width of gap 45*a* would have to be increased). At the same time, the other end of wrench 50 (see FIG. 3A) would include the four smaller gripping surface sizes 35 through 38, with wrench head assembly 51*b* defining gripping surfaces 35 and 36, and wrench head assembly 52*b* defining gripping surfaces 37 and 38 to provide a continuous set of sizes from gripping surfaces 31 through 38. Wrench head assembly 52*b* with gripping surfaces 37 and 38 would still determine the width of gap 45*b*, so the width of handle hinge paw 43*b* can remain nearly unchanged by the modification of wrench head 51*b* to have gripping surfaces 35 and 36. Thus, the shown arrangement of sizes shown in FIG. 3A, represents a highly optimized configuration to minimize the widths of the handle hinge paws 43*a-b* and improve the ergonomics of a wrench hand tool.

The other examples of double nested wrench ends, shown in this patent, operate substantially the same way as described above. The vertical height of the wrench heads and gripping surfaces can be adjusted as needed, which can effect the overall range of rotation of the pivotal wrench head assemblies. In general, the smaller the vertical height of the wrench heads the larger the range of rotation for the wrench head assemblies. However, even with very tall wrench heads (large vertical height) the larger wrench can still have a range of rotation greater than one-hundred eighty degrees, and the smaller wrench head assembly (double nested wrench head) can have a range of rotation greater than three-hundred sixty degrees, which is sufficient for nearly all the useful orientations for both the large and small wrench heads (single nested and double nested wrench heads, respectively).

In FIG. 2C, we see wrench end 50*c* having three wrench head assemblies 51*c*, 52*a*, and 52*c* mounted pivotally on hinge paw 43*c* with pivot pin 44*c*. Wrench head assemblies 51*c* and 52*a* can have a pivotal range similar to the pivotal range of rotation 59*a-b*, respectively on wrench 50. The third wrench head assembly 52*c* can have a pivotal range of rotation similar to range of rotation 59*b* of wrench head assembly 52*a* and can pass through wider hinge paw 43*c* like wrench head 52*a*. Because wrench head 52*c* can pivot past both wrench head 52*a* and hinge paw 43*c*, the positioning of wrench head 52*c* is not limited by the position of wrench head assembly 52*a*, and can easily pivot to useful orientations with both wrench heads 51*c* and 52*a* pivoted out of its way.

Operation of Additional Tools (FIGS. 4B-D and 5)

In FIGS. 4B-D, the operation of additional tools can be similar to the operation of that tool in its standard form. For example, for a hammer you would generally pound with it, for a pair of pliers you would grip with it, for a pry bar you would pry with it, and for a screwdriver you would screw rotary fasteners with it. To save space on the disclosed hand tools, these additional tools can use the wrench handles and wrench head assemblies as the hand grip for the additional tool(s). For example, in FIG. 4B we see folding hand tool 70*a* with two folding handles 62*a-b* supporting double nested wrench ends. Screwdriver assembly 80 is mounted securely to central hub 65 and handles 62*a-b* can be pivoted one-hundred eighty degrees from their shown position in FIG. 4B to the opposite side of central hub 65 (see range of rotation arrows 79*a-b*, respectively). Properly positioned surfaces on support member 65*c* can provide a stop for handles 62*a-b* and provide a stable stopping position for handles 62*a-b* with respect to central hub 65. If support member 65*c* stops handles 62*a-b* before they touch on the opposite side of central hub 65 (away from the screwdriver 80), then the user can squeeze handles 62*a-b* toward each other forcing them against the stopping surfaces on support member 65*c*. This can lock central hub 65 in place with respect to handles 62*a-b* and allow the use of screwdriver tool 80 without it pivoting with respect to handles 62*a-b*. In this way, screwdriver arm 62*c* and handles 62*a-b* can be forced to hold their position with respect to each other while being used. Alternatively, the hinges defined at hinge pins 66*a-b* can include a locking mechanism to hold handles 76*a-b* in a fixed orientation with respect to hub 65 and screwdriver assembly 80*a*, and allow the use of handles 76*a-b* as a screwdriver handle.

In FIG. 5, folding wrench 70*b* is designed to receive screwdriver assembly 80*a* into screwdriver arm 77 on central hub 75. As with screwdriver 80 on hand tool 70*a* (see FIG. 4B), handles 76*a-b* on wrench 70*b* can be rotate approximately one-hundred eighty degrees to the left of central hub 75 before the surfaces of support member 75*a* stop their rotation. Thus, screwdriver assembly 80*a* can extend to the right in FIG. 5, while handles 76*a-b* extend to the left. Support member 75*a* provides a stopping surface for handles 76*a-b* so that squeezing handles 76*a-b* on the left side of central hub 75 forces the folding hinge end of handles 76*a-b* against the top and bottom surfaces of support member 75*a*, respectively. These forces tend to hold central hub 75 (and screwdriver arm body 77*a*) in place with respect to handles 76*a-b* during use of screwdriver assembly 80*a*. This allows the user to grip handles 76*a-b*, and their respective wrench ends, and use them as a screwdriver hand grip. Screwdriver assembly 80*a* can be reversibly mounted in arm 77 to alternately select screwdriver bits 82*a* or 82*b*. Screwdriver bits 82*a-b* can also be reversibly mounted in attachment ports 84*a-b*, respectively, to allow the use of all four ends of screwdriver bits 82*a-b*.

Operation of Pivotal Handle (FIGS. 3B, 4A-D, and 5)

All the hand tools disclosed in this patent provide a folding handle except wrench 50. These folding handles allow multiple positions for the handle to allow the wrenches and other tools to get into hard to reach places. The folding handles can allow several different operational positions for the disclosed hand tools. These operational positions or configurations can comprise: 1) a stowed position, 2) a short-handle operational position, 3) a long-handle operational position, 4) a crank handle operational position, 5) a short-handle with extension operational position, 6) a screwdriver handle operational position, and 7) a double handle operational position.

Stowed Positions (FIGS. 4A-B, and 5)

One of the major advantages of the disclosed double nested wrench tools is that they can have a folding design to allow a compact, pocket ready form, for stowage. The stowed position can minimize the overall size of the tool set by moving two portions of the hand tool substantially next to one another and/or longitudinally adjacent one another. The stowed position is one of the most useful modes for a folding hand tool and substantially allows the hand tool to fold in half to reduce its length for stowage. In FIG. 3B we see wrench hand tool 70 with a folding handle assembly 60. Hinge pin 66 is approximately in the middle of the wrench so that when folded, wrench 70 forms a compact storable package (see FIG. 4A). In this particular design, the length of handles 61*a-b* are chosen so that large vertical height wrench head 71*b* can fold into gripping surface 31*a* of wrench head 71*a*. This allows the wrench head assemblies 71*a-b* and 72*a-b*, and handles 61*a-b* to fold more compactly. Each folding handle design presented here has a stowed position shown in FIGS. 4A, 4B, and 5. For folding hand tools that have a central hub (see FIGS. 4B and 5), two stowed positions can exist, with the handles folded together on either side of its central hub. With added tools like screwdriver assemblies 80 and 80*a*, the most compact stowed position is with the handles folded on the same side as the screwdriver. However, without the added tools, either side will form a compact stowed position.

Short Handle Operation (FIGS. 4B and 5)

Many of the hand tool designs disclosed in this patent can be used when in their stowed position with their handles folded together to from a short hand grip handle for the user. In the stowed position shown in FIGS. 4B and 5, gripping surfaces 32, 34, 36 and 38 are facing outward from hand tools 70*a-b* and can be used to turn a rotary fastener by gripping their handles. If both handles 62*a-b* on hand tool 70*a*, and handles 76*a-b* on hand tool 70*b* seen in FIGS. 4B and 5 are pivoted together on the left, a second short handle position is created that orients gripping surfaces 31, 33, 35, and 37 facing outward so they can be used to turn a rotary fastener. Thus, with these two short handle positions (both somewhat stowed positions) all eight gripping surfaces can be used from a stowed or short handle position. These configurations thus provide a short handle position since the handle length is significantly reduced in these folded together positions.

Long Handle Operation (FIGS. 3A, 3B, 4B and 5)

All of the double nested wrench tools disclosed in this patent can operate in a long handle position. Some designs like wrench 50 are fixed in a long handle position with a handle that cannot fold. The other designs that can unfold to an extended or long handle position to provide maximum torque to a rotary fastener. These long handle configurations in many cases can be considered the "normal" operating positions for a particular tool. When in use, one handle becomes the tool end while the other handle is used as a handle hand grip. For example, in FIG. 3A, when gripping surface 32 is being used on a particular rotary fastener, the smaller hinge paw 43*b* and wrench head assembly 51*b* become the handle hand grip for the user to grip and apply torque to the rotary fastener. If gripping surface 34 is being used to turn a particular fastener, the larger hinge paw 43*a* and wrench head assembly 51*a* can be used as the handle hand grip for the user to grip and apply torque to a fastener. The situation is similar for the other wrench hand tools 70, 70*a*, and 70*b* when extended. One end of these wrenches is used as the tool end, and the other end is used as the handle, and vice versa. A range of angles for the folding hinges on the handles can be used while still being considered in a long handle position.

In FIGS. 4B and 5, folding hand tools 70*a* and 70*b* can use its additional tool (screwdriver) as a hand grip during use. For example, screwdriver arm 77 and screwdriver assembly 80*a* can remain adjacent either handle 76*a* or 76*b* while the other handle is folded out for use (extended long-handle position). This means that arm 77 and screwdriver assembly 80*a* can become part of the hand grip for the user. For example, in FIG. 5, handle 76*b* can be folded out to the left for use of wrench head 51*b* or 52*b* to turn a rotary fastener with gripping surfaces 33*b*, 34*b*, 37*b*, or 38*b*. At the same time, arm 77, screwdriver assembly 80*a*, handle 76*a*, and wrench heads 51*d* and 52*a* remain on the right side and can be used as the hand grip for the wrench. A similar situation exists if handle 76*a* is folded out to the left for use, and handle 76*b* and screwdriver assembly 80*a* is used as the hand grip for the wrench. Of course other tools can be substituted for screwdriver assemblies 80 and 80*a* and still allow similar operation of hand tools 70*a* and 70*b*, respectively.

Crank Handle Operation (FIG. 4A)

The reader should realize that there is a continuum of angles that the tool handles can be placed in not just the example ones discussed here. When the angle of the two handles is near ninety degrees, a different mode of operation occurs. For example, in FIG. 4A, with handle 61*b* pivoted to position 61*z*, handles 61*a* and 61*b* are at right angles to each other. In this right angle position, handle 61*b* can be used like a crank handle to turn handle 61*a* around gripping surface 32*a* (as shown in FIG. 4A) and apply torque to gripping surface 32*a*. For gripping surface 31*a* to be used in this way, handle 61*b* can be rotated to its furthest extent 61*y* so that it can be used as a crank handle to turn handle 61*a* (see range of motion 79 for handle 61*b*, in FIG. 4A). In this way all the wrench gripping surfaces on pivot pin 44*a* can be used. In the same ninety-degree handle position, handle 61*a* can be used as the crank handle and handle 61*b* along with wrench head assemblies 71*b* and 72*b* can be used to turn a rotary fastener. These same configurations are possible on hand tools 70*a* and 70*b*. Notice also that many additional crank handle positions are possible. For example, in FIG. 4A, if wrench head 71*a* is rotated to position 71*y*, and handle 61*b* rotated slightly past position 61*z*, then handle 61*b* can be used as a crank handle for gripping surface 31*a*.

Short Handle with Tool Extension (FIG. 4A)

The disclosed folding wrenches can also use each of their folding handles by themselves as a short handle while the other folding handle becomes a tool extension position. This arrangement also uses the tool handles at right angles with each other, but there operation is quite different. For example, in FIG. 4A, with handle 61*b* pivoted to position 61*z* and wrench head assembly 72*a* pivoted to a right angle position

72*y*, handle 61*b* can then be used as a short handle to turn handle 61*a* along its axis for and turn wrench head 71*a*. This arrangement allows handle 61*a* to be used like a socket extension for gripping surface 36*a* who's rotational axis is substantially parallel to the longitudinal axis of handle 61*a* when in position 72*y*. Handle 61*b* in position 61*z* is then used like a short handle to apply torque along the longitudinal axis of handle 61*a* to turn gripping surface 36*a*. Each of the other gripping surfaces on wrench heads 71*a* and 72*a* can be used the same way by pivoting them so that their gripping surface axis is facing away from and substantially parallel to handle 61*a*. With the same right angle position of handles 61*a-b*, handle 61*b* can be uses as a tool extension, and handle 61*a* can be used as the a short handle to turn handle 61*b* along its longitudinal axis and provide torque to the gripping surfaces on wrench heads 71*b* and 72*b*. This allows each handle to be used as an extension to get down into a deep depression to reach a rotary fastener at the bottom. Hand tools 70*a* and 70*b* can provide similar configurations and functionality. For short handle operation with tool extension, having a locking mechanisms at the hinges formed by pivot pins 44*a-b* can be very useful to temporarily lock the wrench head assemblies in place during use. Such locking mechanisms would allow the user to apply pressure onto the rotary fastener being turned without worry that the wrench head assembly will pivoting under the force. Such locking mechanisms can also be useful for other handle configurations.

Screwdriver Handle (FIGS. 4A, 4B and 5)

The disclosed folding handles can also allow the hand tools to be used like a screwdriver if properly designed. For example, in FIG. 4A, with handles 61*a-b* folded together as shown, handles 61*a-b* can be used as a screwdriver style hand grip for wrench head assemblies 71*a-b* and 72*a-b*. These wrench head assemblies can be pivoted to a right angle position (see position 72*y*) so that the axis of the wrench head's gripping surface (see gripping surface 36*a*) is substantially parallel to the longitudinal axis of wrench handles 61*a-b*. This allows twisting motion of handles 61*a-b* to turn the gripping surfaces to turn a rotary fastener. Similarly, in FIGS. 4B and 5, handles 62*a-b* and 76*a-b*, respectively, can be used as a screwdriver hand grip to turn wrench head assemblies 51*a-b* and 52*a-b*. The use of this screwdriver style configuration for turning wrench heads works best when the folding handles are close to the same length so that each gripping surface can be positioned at the extreme end of the hand tool for use. Folding hand tool 70*b*, seen in FIG. 5, is the only design shown that is optimized for this type of operation. Besides using these screwdriver style hand grips for turning wrench heads, FIGS. 4B and 5, show hand tools 70*a* and 70*b* can also be use to turn screwdriver assemblies 80 and 80*a*, respectively. The handles on both hand tools 70*a-b* can be pivot together on the opposite side of the central hub from their screwdriver tool. With a means for locking the handles in place, the user can grip the handles and use them like a screwdriver hand grip to use screwdriver assemblies 80 and 80*a*. Each hand tool 70*a-b* uses support member 65*c* and 75*a*, respectively, to provide a stop for the rotation of, and provide a stable position for handles 61*a-b* and 62*a-b*, respectively, so that the user can operate the screwdriver.

Double Handle (FIG. 5)

A double handle mode of operation is possible with the disclosed folding hand tools that have a central hub and an additional elongated tool. In FIG. 5, with screwdriver assembly 80*a* mounted in attachment channel 77*b*, assembly 80*a* can act like a third handle allowing any two of the three functional handles (wrench handles 76*a*, and 76*b*, and screwdriver assembly 80*a*) to turn the third handle. For example, if handles 76*a-b* are rotated ninety degrees from their shown positions they form a double handle grip for turning screwdriver arm 77 and assembly 80*a*. For effective use in this position, the hinges formed by hinge pins 66*a-b* can have a pivotal locking means to allow hub 75 to be stable during use. If handle 76*b* is pivoted one-hundred eighty degrees to the left and handle 76*a* is pivoted ninety degrees to a straight down position, handle 76*b* and arm 77 with assembly 80*a* can be used as a double handle to turn handle 76*a* along its longitudinal axis. In this position, handle 76*a* acts like a tool extension for wrench head assemblies 51*d* and 52*a*. A similar arrangement exists for using handle 76*b* as a tool extension when handle 76*b* is pivoted ninety degrees and handle 76*a* is pivoted one-hundred eighty degrees.

Finally, the reader should understand that a patent of this length and complexity will have errors in it. For this reason, if a sentence within this document is not clear, or has wording that contradict the rest of the specification, that sentence can be ignored to correct the clarity of the patent. Also, errors in reference numbering is nearly unavoidable in a patent of this size, but the correct reference number should be discernable from the context of the paragraph.

RAMIFICATIONS, and SCOPE

The disclosed double nested wrench ends can provide a full set of wrench tools in a convenient folding handle format. With a folding handle, these hand tools can fold to a very compact state or fold out to an extended position for use of the tools. By using wrench heads with two or more gripping surface sizes, the overall weight of the collection of tools is often much less than half the weight of the same collection of tool separately. For fixed sized wrench sets this weight can be one-fourth as much as a complete standard set of similar sized wrenches. Most of the examples shown in this patent show the hand tools with eight or ten wrench sizes. This was done because of the great advantage of having a full set of wrench sizes permanently attached to each other so they cannot be individually lost. However, wrench sets are commonly sold with as little as four wrench. Further, other tools, besides wrenches can take the place of wrench head assemblies in the disclosed examples.

Although the above description of the invention contains many specifications, these should not be viewed as limiting the scope of the invention. Instead, the above description should be considered illustrations of some of the presently preferred embodiments of this invention. For example, the disclosed duplexed, overlapped, and overlapped/duplex wrench heads are only a few example of the multiple gripping surface wrench head that can be used, and many other wrench head styles, types and sizes can easily be substituted. Variable size gripping surface wrench heads is one possible substitution. For some users, significantly different configurations of gripping surface styles and wrench head construction can be used to provide a specific combination of tools, or more ergonomic configuration for a specific user's need. The examples presented in this patent are only a small fraction of the vast number of configurations for double nested wrenches.

Thus, instead of limiting the protection accorded by this document, or any document which is related to this document, to the material explicitly disclosed herein, the protection should be understood as being defined by the claims when the terms used in those claims which are set fourth below under the label "EXPLICIT DEFINITIONS" are given the explicit definitions set forth under that label, and the remaining terms are given their broadest reasonable interpretation as shown by a general purpose dictionary. To the extent that the interpretation which would be given based on the above disclosure or incorporated priority document is in any way narrower than the interpretation which would be given based on the "EXPLICIT DEFINITIONS" and the broadest reasonable interpretation as shown by a general purpose dictionary, the interpretation provided by the "EXPLICIT DEFINITIONS" and the broadest reasonable interpretation shall control, and the narrower interpretation shall have no effect.

EXPLICIT DEFINITIONS

When used in the claims "SUBSTANTIALLY PARALLEL" should be understood to mean the relationship between two elongated objects that is within twenty degrees of being exactly parallel.

When used in the claims "SUBSTANTIALLY PERPENDICULAR" should be understood to mean and angle within twenty degrees of being exactly perpendicular.

When used in the claims "FOLDING HINGE" should be understood to mean a hinge that is used to pivot or fold one or more wrench handles (or arms) between a stowed position for stowage and an extended position for use.

When used in the claims "LONGITUDINALLY ADJACENT" should be understood to mean the relational position where two or more elongated objects (e.g. tool arms, wrench handles, wrench head assemblies, screwdriver arms, screwdriver assemblies, etc.) have their elongated sides adjacent another and their longitudinal axes are substantially parallel to a central axis (midpoint of longitudinal axes) of the collection of elongated objects.

I claim:

1. A hand tool for turning rotary fasteners of different sizes, comprising:

a) a handle comprising first end defining a handle hinge paw with a pivotal axis;

b) a first wrench head assembly comprising a multiple size wrench head attached to a pivotal hinge paw, wherein the pivotal hinge paw defines a pivotal axis for pivotally mounting the first wrench head assembly to the handle hinge paw, and c) a second wrench head assembly comprising a multiple size wrench head attached to a pivotal hinge post, wherein the pivotal hinge post defines a pivotal axis for pivotally mounting the second wrench head assembly within the pivotal hinge paw of the first wrench head assembly, wherein the pivotal axes of the handle hinge paw, the pivotal hinge paw and the pivotal hinge post are aligned along the same axis, whereby the first and second wrench heads pivot around a single hinge axis.

2. The hand tool in claim 1, wherein the first wrench head assembly has a range of rotation less than three-hundred sixty degrees, and the second wrench head assembly has a range of rotation greater than three-hundred sixty degrees.

3. The hand tool in claim 1, wherein handle hinge paw has a width that allows the second wrench head assembly to rotate through the handle hinge paw, but will not allow the first wrench head assembly cannot rotate through the handle hinge paw.

4. The hand tool in claim 1, further comprising:

a) a second handle hinge paw defined on the handle;

b) a third wrench head assembly comprising a duplexed wrench head and a second pivotal hinge paw, wherein the second pivotal hinge paw defines a pivotal axis for pivotally mounting the third wrench head assembly to the second handle hinge paw, and c) a fourth wrench head assembly comprising a duplexed wrench head attached to a second pivotal hinge post, wherein the second pivotal hinge post defines a pivotal axis for pivotally mounting the second pivotal hinge post within the second pivotal hinge paw of the third wrench head assembly, wherein the pivotal axes of the second handle hinge paw, the second pivotal hinge post, and the second pivotal hinge paw are aligned along the same axis, whereby the third and fourth wrench heads assemblies pivot around a single hinge axis.

5. The hand tool in claim 4, wherein the first and third wrench head assemblies have the largest wrench sizes, and wherein the second and fourth wrench head assemblies have the smallest wrench sizes.

* * * * *